US009051075B2

(12) United States Patent
Scott

(10) Patent No.: US 9,051,075 B2
(45) Date of Patent: Jun. 9, 2015

(54) CORRUGATED CONTAINER BOX AND BLANK

(71) Applicant: William M. Scott, Villa Hills, KY (US)

(72) Inventor: William M. Scott, Villa Hills, KY (US)

( * ) Notice: Subject to any disclaimer, the term of this patent is extended or adjusted under 35 U.S.C. 154(b) by 0 days.

(21) Appl. No.: 13/837,387

(22) Filed: Mar. 15, 2013

(65) Prior Publication Data

US 2014/0069993 A1 Mar. 13, 2014

Related U.S. Application Data

(60) Provisional application No. 61/698,229, filed on Sep. 7, 2012.

(51) Int. Cl.

| | |
|---|---|
| ***B65D 5/26*** | (2006.01) |
| ***B65D 5/468*** | (2006.01) |
| ***B65D 5/68*** | (2006.01) |
| ***B65D 5/42*** | (2006.01) |
| ***B65D 5/66*** | (2006.01) |
| ***B65D 5/20*** | (2006.01) |
| ***B65D 55/02*** | (2006.01) |

(52) U.S. Cl.

CPC ..... *B65D 5/4279* (2013.01); *B65D 5/6667* (2013.01); *B65D 5/68* (2013.01); *B65D 5/2047* (2013.01); *B65D 5/26* (2013.01); *B65D 5/4608* (2013.01); *B65D 55/02* (2013.01)

(58) Field of Classification Search

CPC ..... B65D 5/26; B65D 5/4608; B65D 5/68; B65D 5/4279

USPC ..... 229/117.16, 125.19, 145, 194

See application file for complete search history.

(56) References Cited

U.S. PATENT DOCUMENTS

| | | | | |
|---|---|---|---|---|
| 238,117 | A | 2/1881 | Hillman | |
| 600,879 | A | 3/1898 | Louden | |
| 650,624 | A * | 5/1900 | Webb | 229/194 |
| 1,198,435 | A * | 9/1916 | Gebart | 229/194 |
| 1,302,361 | A * | 4/1919 | Gordon | 229/194 |
| 1,457,770 | A | 6/1923 | Dodge | |
| 1,465,691 | A | 8/1923 | Snedeker | |

(Continued)

FOREIGN PATENT DOCUMENTS

| | | |
|---|---|---|
| JP | 735313 U | 6/1995 |
| JP | 10152125 A | 6/1998 |

(Continued)

OTHER PUBLICATIONS

Acrylic Desktop File Holder; http://www.alibaba.com/product-gs/541368370/acrylic_desktop_file_holder.html; Copyright ©1999-2012 Alibaba.com Hong Kong Limited and licensors; printed Oct. 24, 2012; (3 pages).

(Continued)

*Primary Examiner* — Gary Elkins

(74) *Attorney, Agent, or Firm* — Patents on Demand, P.A.; Brian K. Buchheit; Scott M. Garrett

(57) ABSTRACT

An open-ended container having a pair of opposed sidewalls that are formed from a first sidewall member having a slot and a second sidewall member comprising an extending tab that extends through the slot of the first sidewall member. A blank of a single board is stamped and folding into a container, and uses less board material by weight than a conventional container box. The open-ended container has a pair of grip openings in opposed sidewalls for lifting and carrying.

9 Claims, 16 Drawing Sheets

(56) References Cited

U.S. PATENT DOCUMENTS

| | | | | | |
|---|---|---|---|---|---|
| 1,623,547 | A | | 4/1927 | Neumann | |
| 1,865,688 | A | | 7/1932 | Hannaford | |
| 1,897,672 | A | | 2/1933 | Neumann | |
| 1,955,663 | A | * | 4/1934 | Wendell et al. | 229/194 |
| 1,974,674 | A | | 9/1934 | Halladay et al. | |
| 2,019,371 | A | | 10/1935 | Tompkins | |
| 2,054,355 | A | | 9/1936 | Anderson, Jr. | |
| 2,076,065 | A | * | 4/1937 | William | 229/194 |
| 2,094,054 | A | | 9/1937 | Bixby | |
| 2,124,409 | A | | 7/1938 | Andrews | |
| RE21,386 | E | | 3/1940 | Crawford | |
| 2,201,462 | A | | 5/1940 | Wells et al. | |
| 2,218,509 | A | * | 10/1940 | Goodyear | 229/194 |
| 2,249,265 | A | | 7/1941 | Bauder | |
| 2,253,008 | A | | 8/1941 | Anderson, Jr. | |
| 2,289,619 | A | | 7/1942 | Anderson, Jr. | |
| 2,297,284 | A | | 9/1942 | Blackman | |
| 2,307,349 | A | | 1/1943 | Anderson, Jr. | |
| 2,307,350 | A | | 1/1943 | Anderson, Jr. | |
| 2,330,294 | A | | 9/1943 | Leavitt et al. | |
| 2,365,182 | A | | 12/1944 | Ferguson | |
| 2,418,963 | A | | 4/1947 | Anderson, Jr. | |
| 2,460,230 | A | | 1/1949 | Makrianes | |
| 2,487,302 | A | | 11/1949 | Bradley | |
| 2,523,908 | A | | 9/1950 | Johnsen | |
| 2,537,801 | A | | 1/1951 | Swatsick | |
| 2,544,283 | A | * | 3/1951 | Snyder | 229/117.16 |
| 2,559,552 | A | | 7/1951 | Welshenbach | |
| 2,561,979 | A | | 7/1951 | George | |
| 2,564,948 | A | | 8/1951 | Beck, Jr. et al. | |
| 2,597,847 | A | | 5/1952 | Reeser | |
| 2,604,255 | A | | 7/1952 | Welshenbach | |
| 2,629,499 | A | | 2/1953 | Welshenbach | |
| 2,634,038 | A | | 4/1953 | George et al. | |
| 2,645,353 | A | | 7/1953 | Anderson, Jr. | |
| 2,654,527 | A | | 10/1953 | Geckler et al. | |
| 2,698,124 | A | | 12/1954 | Hines | |
| 2,769,550 | A | | 11/1956 | Rollins et al. | |
| 2,788,933 | A | | 4/1957 | Kessler | |
| 2,822,973 | A | | 2/1958 | Armstrong et al. | |
| 2,827,222 | A | | 3/1958 | Buttery | |
| D186,672 | S | | 11/1959 | Gilruth | |
| 2,925,210 | A | | 2/1960 | Fallert | |
| 2,981,455 | A | | 4/1961 | Cope | |
| 3,002,650 | A | | 10/1961 | Lovell | |
| 3,005,717 | A | | 10/1961 | Pilibos | |
| 3,049,279 | A | | 8/1962 | Mairs et al. | |
| 3,107,041 | A | | 10/1963 | Wagner, Jr. | |
| 3,114,493 | A | | 12/1963 | Dunkin | |
| 3,118,588 | A | | 1/1964 | Noble | |
| 3,138,283 | A | | 6/1964 | Peebles | |
| 3,155,235 | A | | 11/1964 | Maich | |
| D200,699 | S | | 3/1965 | Pappas | |
| 3,175,750 | A | | 3/1965 | Bump | |
| 3,186,586 | A | | 6/1965 | Box | |
| 3,195,798 | A | | 7/1965 | Wilson | |
| 3,206,098 | A | * | 9/1965 | Stenger et al. | 229/145 |
| 3,270,946 | A | * | 9/1966 | Redpath et al. | 229/194 |
| D206,304 | S | | 11/1966 | Pinzke | |
| 3,282,462 | A | | 11/1966 | Box | |
| 3,301,386 | A | | 1/1967 | Carter | |
| 3,301,461 | A | | 1/1967 | Kroeschell | |
| 3,314,532 | A | | 4/1967 | Henry | |
| 3,366,496 | A | | 1/1968 | Bomar et al. | |
| 3,379,341 | A | | 4/1968 | Miles | |
| 3,391,698 | A | | 7/1968 | Wiles | |
| 3,392,904 | A | * | 7/1968 | Wei | 229/117.16 |
| 3,396,898 | A | * | 8/1968 | Dorfmann | 229/194 |
| 3,438,562 | A | | 4/1969 | Connor et al. | |
| 3,568,918 | A | | 3/1971 | Blomqvist | |
| 3,622,036 | A | | 11/1971 | McVeigh | |
| 3,622,063 | A | | 11/1971 | McVeigh | |
| 3,664,494 | A | | 5/1972 | Mergens | |
| 3,667,666 | A | | 6/1972 | Pryor | |
| 3,670,949 | A | | 6/1972 | Galanes | |
| 3,684,159 | A | | 8/1972 | Wolfe | |
| 3,692,231 | A | | 9/1972 | Neitzke et al. | |
| 3,698,625 | A | | 10/1972 | Graser | |
| 3,713,579 | A | | 1/1973 | Chaffers | |
| 3,724,920 | A | | 4/1973 | Beck | |
| 3,727,827 | A | | 4/1973 | Stice | |
| 3,797,731 | A | | 3/1974 | Weldon | |
| 3,831,834 | A | | 8/1974 | Elward | |
| 3,844,473 | A | | 10/1974 | Whelan | |
| 3,860,113 | A | | 1/1975 | Helms | |
| 3,862,687 | A | | 1/1975 | Pirman | |
| 3,910,483 | A | | 10/1975 | Ritter | |
| 3,952,940 | A | | 4/1976 | Malcolm | |
| D242,021 | S | | 10/1976 | Shanklin | |
| 4,030,600 | A | | 6/1977 | Heaps | |
| D244,994 | S | | 7/1977 | Flanagan | |
| 4,082,215 | A | | 4/1978 | Eichenauer | |
| 4,101,052 | A | | 7/1978 | Dove | |
| 4,114,300 | A | | 9/1978 | Holson | |
| 4,127,228 | A | | 11/1978 | Hall | |
| 4,142,665 | A | | 3/1979 | Jewell et al. | |
| 4,172,522 | A | | 10/1979 | Muller et al. | |
| 4,199,832 | A | | 4/1980 | Glasscock et al. | |
| 4,201,330 | A | | 5/1980 | Gilbert | |
| 4,228,904 | A | | 10/1980 | Dumond | |
| 4,230,261 | A | | 10/1980 | Austin | |
| 4,265,391 | A | | 5/1981 | Zornes et al. | |
| 4,285,150 | A | | 8/1981 | Richardson et al. | |
| 4,291,830 | A | | 9/1981 | Sorensen | |
| D263,899 | S | | 4/1982 | Lynn | |
| 4,325,493 | A | | 4/1982 | Paige | |
| 4,339,069 | A | | 7/1982 | Poteet | |
| 4,356,952 | A | | 11/1982 | Rekow | |
| 4,380,290 | A | | 4/1983 | Leubke | |
| 4,504,497 | A | | 3/1985 | Kurth et al. | |
| 4,531,667 | A | | 7/1985 | Meade | |
| 4,542,832 | A | | 9/1985 | Minick et al. | |
| 4,588,077 | A | | 5/1986 | Champlin et al. | |
| 4,617,702 | A | | 10/1986 | Diederich, Jr. | |
| 4,655,366 | A | | 4/1987 | Sykes | |
| 4,717,023 | A | | 1/1988 | Oprean | |
| D297,214 | S | | 8/1988 | Forbes, Jr. | |
| 4,768,704 | A | | 9/1988 | Beckway et al. | |
| 4,817,861 | A | | 4/1989 | Henrikson | |
| 4,830,268 | A | | 5/1989 | Pitts | |
| 4,838,436 | A | | 6/1989 | Bailey | |
| 4,905,834 | A | | 3/1990 | Mur Gimeno et al. | |
| 4,927,074 | A | | 5/1990 | LaRue et al. | |
| 4,948,033 | A | | 8/1990 | Halsell, II et al. | |
| 4,961,497 | A | | 10/1990 | Sherer et al. | |
| D312,402 | S | | 11/1990 | Boggus, Jr. | |
| D312,531 | S | | 12/1990 | Sherer et al. | |
| D315,098 | S | | 3/1991 | Hutcheson | |
| 5,011,071 | A | | 4/1991 | Lopez | |
| 5,016,814 | A | | 5/1991 | Fullerton | |
| 5,042,657 | A | | 8/1991 | Dunn | |
| 5,042,715 | A | * | 8/1991 | McNeill | 229/117.15 |
| 5,064,069 | A | | 11/1991 | Su | |
| 5,076,491 | A | | 12/1991 | Freudentahl et al. | |
| D326,341 | S | | 5/1992 | Frauhiger | |
| 5,111,957 | A | | 5/1992 | Hollander et al. | |
| 5,119,950 | A | | 6/1992 | Takemura | |
| 5,148,942 | A | | 9/1992 | Snook | |
| 5,148,973 | A | | 9/1992 | Zimmerman | |
| 5,156,328 | A | | 10/1992 | Wozniacki | |
| 5,295,632 | A | | 3/1994 | Zink et al. | |
| 5,322,167 | A | | 6/1994 | Birutis et al. | |
| D348,390 | S | | 7/1994 | Van Ness | |
| 5,333,777 | A | | 8/1994 | Roth | |
| 5,335,844 | A | | 8/1994 | Young | |
| 5,402,932 | A | | 4/1995 | Fadaie | |
| 5,411,145 | A | | 5/1995 | Parks | |
| 5,429,295 | A | | 7/1995 | Levy | |
| D361,892 | S | | 9/1995 | Quaintance | |
| 5,494,161 | A | | 2/1996 | Herbst | |
| 5,503,324 | A | | 4/1996 | Bacchetti et al. | |
| 5,505,371 | A | | 4/1996 | O'Neill | |
| D372,673 | S | | 8/1996 | Turner | |
| 5,579,917 | A | | 12/1996 | Lofgren et al. | |

(56) References Cited

U.S. PATENT DOCUMENTS

| | | | |
|---|---|---|---|
| 5,699,959 | A | 12/1997 | Huspeka et al. |
| D391,079 | S | 2/1998 | Conti et al. |
| D394,950 | S | 6/1998 | Kite |
| 5,765,695 | A | 6/1998 | Picciallo |
| 5,779,129 | A | 7/1998 | Herbst et al. |
| 5,794,780 | A | 8/1998 | Parrella et al. |
| D398,228 | S | 9/1998 | Herbst et al. |
| D398,230 | S | 9/1998 | Herbst et al. |
| D399,366 | S | 10/1998 | Stravitz |
| 5,884,783 | A | 3/1999 | Proulx |
| 5,887,782 | A | 3/1999 | Mueller |
| 5,890,650 | A | 4/1999 | Penson |
| 5,908,152 | A | 6/1999 | Tullis |
| D419,302 | S | 1/2000 | Hardy et al. |
| D420,704 | S | 2/2000 | Coe |
| D421,183 | S | 2/2000 | Koskinen |
| 6,036,042 | A | 3/2000 | Pietruch et al. |
| D422,499 | S | 4/2000 | Herbst et al. |
| D423,587 | S | 4/2000 | Conley et al. |
| D424,117 | S | 5/2000 | Steinbeck et al. |
| D425,128 | S | 5/2000 | Conley et al. |
| D425,562 | S | 5/2000 | Conley et al. |
| 6,059,180 | A | 5/2000 | Collins |
| 6,070,719 | A | 6/2000 | Pollock |
| 6,123,254 | A | 9/2000 | Dupuis |
| 6,135,347 | A | 10/2000 | Mueller |
| D434,223 | S | 11/2000 | Dombrowski |
| 6,149,052 | A | 11/2000 | Mueller |
| 6,164,461 | A | 12/2000 | Ward et al. |
| D436,728 | S | 1/2001 | Harding |
| D441,653 | S | 5/2001 | LeRoux |
| D442,780 | S | 5/2001 | Hiernard |
| 6,237,840 | B1 | 5/2001 | Grabowski et al. |
| 6,290,124 | B2 | 9/2001 | Andrews, Sr. et al. |
| D448,567 | S | 10/2001 | Buss |
| D448,568 | S | 10/2001 | Sadr |
| 6,311,891 | B1 | 11/2001 | Gardner |
| D451,675 | S | 12/2001 | Hardy et al. |
| D453,275 | S | 2/2002 | Stravitz |
| 6,352,157 | B1 | 3/2002 | Srinivasan |
| D461,120 | S | 8/2002 | Ostro |
| 6,439,452 | B1 | 8/2002 | Tsao |
| 6,499,781 | B1 | 12/2002 | Flynn |
| D468,638 | S | 1/2003 | Nogami et al. |
| 6,527,167 | B1 | 3/2003 | Sheffer |
| D477,217 | S | 7/2003 | Riedi |
| 6,604,675 | B2 | 8/2003 | Southwell |
| 6,619,540 | B1 * | 9/2003 | Bazany ..... 229/117.16 |
| D480,273 | S | 10/2003 | Cordwell |
| 6,641,032 | B1 | 11/2003 | Schilling |
| 6,669,080 | B2 | 12/2003 | Ong |
| D485,466 | S | 1/2004 | Haruhiro |
| 6,705,515 | B2 | 3/2004 | Dowd |
| 6,708,874 | B1 | 3/2004 | Montgomery |
| 6,719,191 | B1 | 4/2004 | Christensen et al. |
| D494,759 | S | 8/2004 | Louie et al. |
| D495,490 | S | 9/2004 | Garrett et al. |
| 6,830,156 | B2 | 12/2004 | MacKelvie |
| D503,614 | S | 4/2005 | Sax et al. |
| 6,889,893 | B2 | 5/2005 | Kent |
| D507,404 | S | 7/2005 | Moon et al. |
| D508,042 | S | 8/2005 | Oikawa |
| D510,521 | S | 10/2005 | Lebras |
| D510,823 | S | 10/2005 | Ng et al. |
| D518,526 | S | 4/2006 | Benn |
| D518,708 | S | 4/2006 | Ohayon |
| D526,357 | S | 8/2006 | Killinger et al. |
| D526,893 | S | 8/2006 | Nixon |
| D527,424 | S | 8/2006 | Long |
| D536,964 | S | 2/2007 | Smith et al. |
| D539,036 | S | 3/2007 | Potts et al. |
| D542,033 | S | 5/2007 | Kopenhaver et al. |
| 7,210,614 | B2 | 5/2007 | Mazurek |
| D548,072 | S | 8/2007 | Nixon |
| D548,782 | S | 8/2007 | Nash |
| D549,096 | S | 8/2007 | Ayats et al. |
| D549,575 | S | 8/2007 | Pinkstone |
| D551,860 | S | 10/2007 | Northrop |
| D558,047 | S | 12/2007 | Pinkstone |
| 7,331,451 | B2 | 2/2008 | Focke et al. |
| D569,105 | S | 5/2008 | Van Hoorn |
| D570,684 | S | 6/2008 | Kisch |
| 7,387,350 | B2 | 6/2008 | Killinger et al. |
| D575,452 | S | 8/2008 | Jones et al. |
| 7,410,094 | B2 | 8/2008 | Bos |
| 7,438,198 | B2 | 10/2008 | Pickles |
| D581,782 | S | 12/2008 | Kisch |
| D583,660 | S | 12/2008 | Steiger et al. |
| D587,996 | S | 3/2009 | Steiger et al. |
| D599,202 | S | 9/2009 | Whiteside |
| 7,611,020 | B2 | 11/2009 | Prest |
| D610,000 | S | 2/2010 | Schantz |
| 7,654,408 | B2 | 2/2010 | Bazany |
| D610,904 | S | 3/2010 | Russell et al. |
| D613,899 | S | 4/2010 | Whittier et al. |
| D614,484 | S | 4/2010 | Schantz |
| D615,775 | S | 5/2010 | Fairbanks |
| D617,185 | S | 6/2010 | Wager |
| 7,726,552 | B2 | 6/2010 | Chadima |
| D622,140 | S | 8/2010 | Elhalwani |
| D627,562 | S | 11/2010 | Osiecki et al. |
| D629,163 | S | 12/2010 | Sullivan |
| D633,296 | S | 3/2011 | Potts et al. |
| D641,620 | S | 7/2011 | Hammond et al. |
| D643,302 | S | 8/2011 | Stone |
| D651,076 | S | 12/2011 | Van Berlo |
| 8,079,474 | B1 | 12/2011 | Flaming |
| D657,562 | S | 4/2012 | McNamara |
| D657,748 | S | 4/2012 | Hargreaves et al. |
| 8,152,050 | B2 | 4/2012 | Busam et al. |
| D658,407 | S | 5/2012 | Pung et al. |
| D661,096 | S | 6/2012 | Dretzka |
| D662,133 | S | 6/2012 | Smith et al. |
| 8,220,701 | B2 | 7/2012 | Fontaine et al. |
| D665,846 | S | 8/2012 | Chuang |
| 8,251,276 | B2 | 8/2012 | McLeod |
| D666,830 | S | 9/2012 | Glenn |
| D671,321 | S | 11/2012 | Scott |
| D671,322 | S | 11/2012 | Scott |
| D671,323 | S | 11/2012 | Scott |
| D673,368 | S | 1/2013 | Scott |
| D675,443 | S | 2/2013 | Scott |
| D678,058 | S | 3/2013 | Vanden Boom et al. |
| D679,094 | S | 4/2013 | Scott |
| D680,427 | S | 4/2013 | Macaulay et al. |
| D680,428 | S | 4/2013 | Vanden Boom et al. |
| D681,331 | S | 5/2013 | Scott |
| D681,953 | S | 5/2013 | Scott |
| D685,264 | S | 7/2013 | Lai et al. |
| D685,634 | S | 7/2013 | Scott |
| D685,649 | S | 7/2013 | Banuelos |
| D690,105 | S | 9/2013 | Scott |
| D690,106 | S | 9/2013 | Scott |
| D690,107 | S | 9/2013 | Scott |
| D690,126 | S | 9/2013 | Ogawa |
| D698,152 | S | 1/2014 | Scott |
| 2001/0052477 | A1 | 12/2001 | McNeill |
| 2002/0125308 | A1 | 9/2002 | McLeod |
| 2003/0168502 | A1 | 9/2003 | Kisch |
| 2003/0183679 | A1 | 10/2003 | Ong |
| 2005/0029260 | A1 | 2/2005 | Sheng-Bin |
| 2005/0241971 | A1 | 11/2005 | Zou et al. |
| 2005/0284906 | A1 | 12/2005 | Potts et al. |
| 2006/0022026 | A1 | 2/2006 | Yandian et al. |
| 2006/0054669 | A1 | 3/2006 | Hsieh |
| 2006/0243784 | A1 | 11/2006 | Glaser et al. |
| 2006/0266807 | A1 | 11/2006 | Shook |
| 2007/0051787 | A1 | 3/2007 | Schille et al. |
| 2007/0272630 | A1 | 11/2007 | De Luca |
| 2008/0054059 | A1 | 3/2008 | Chadima |
| 2008/0093233 | A1 | 4/2008 | Jones et al. |
| 2008/0173703 | A1 | 7/2008 | Westerman et al. |
| 2009/0020444 | A1 | 1/2009 | Green |

(56) References Cited

U.S. PATENT DOCUMENTS

| | | | | |
|---|---|---|---|---|
| 2009/0282843 | A1 | 11/2009 | Brand | |
| 2010/0314268 | A1 | 12/2010 | Goodman | |
| 2012/0267385 | A1* | 10/2012 | Scott | 220/770 |

FOREIGN PATENT DOCUMENTS

| | | | |
|---|---|---|---|
| JP | 2001294231 | A | 10/2001 |
| JP | 2003026157 | A | 1/2003 |
| JP | 2004526633 | A | 9/2004 |
| JP | 2006021808 | A | 1/2006 |
| JP | 2009029481 | A | 2/2009 |
| WO | 9925621 | A1 | 5/1999 |

OTHER PUBLICATIONS

Acrylic Magazine Holder (M-Shape), http://www.alibaba.com/product-gs/274660307/Acrylic_magazine_holder_M_shape_.html; Copyright ©1999-2012 Alibaba.com Hong Kong Limited and licensors; printed Oct. 24, 2012; (2 pages).

Zigzag Acrylic Literature/Magazine Holder; http://www.alibaba.com/product-gs/294904097/zigzag_acrylic_literature_magazine_holder_acrylic.html; Copyright ©1999-2012 Alibaba.com Hong Kong Limited and licensors; printed Oct. 24, 2012; (1 page).

Kanteck Acrylic Mini Sorter—KTKAD50; http://www.discountofficeitems.com/office-supplies/desk-organizers/desk-organizers-holders/desktop-file-sorters/kantek-acrylic-mini-sorter/p14879.html; Cart Reference # DGL1647F; Copyright ©2012 DiscountOfficeItems.com; printed Oct. 24, 2012; (3 pages).

Lebon, Hilary (Social Media Pro/Consultant) Marketing Idea for the Day—Corrugated Plastic Totes; http://www.mdi.org/index.php/marketing-idea-for-the-day-corrugated-plastic-totes/; Jun. 28, 2011; Copyright ©2010 MDI; (3 pages).

PCT Search Report and Written Opinion for Corresponding PCT Application No. PCT/US2013/058462; mailed Jan. 14, 2014; (11 pages).

Photo 1 of United States Postal Service bin; published prior to Apr. 28, 2012 (1 page).

Photo 2 of United States Postal Service bins; published prior to Apr. 28, 2012 (1 page).

Screen Shot of No. 1555 tote and 1560 tote; published prior to Apr. 28, 2012 (1 page).

William M. Scott, Pending, U.S. Appl. No. 13/441,434, filed Apr. 6, 2012.

William M. Scott, Pending, U.S. Appl. No. 13/448,349, filed Apr. 16, 2012.

William M. Scott, Pending, U.S. Appl. No. 29/448,659, filed Mar. 13, 2013.

William M. Scott, Pending, U.S. Appl. No. 29/448,535, filed Mar. 13, 2013.

William M. Scott, Pending, U.S. Appl. No. 29/444,761, filed Feb. 4, 2013.

William M. Scott, Pending, U.S. Appl. No. 29/445,333, filed Feb. 11, 2013.

William M. Scott, Pending, U.S. Appl. No. 29/456,352, filed May 30, 2013.

William M. Scott, Pending, U.S. Appl. No. 29/438,590, filed Nov. 30, 2012.

William M. Scott, Pending, U.S. Appl. No. 14/075,324, filed Nov. 8, 2013.

William M. Scott, Pending, U.S. Appl. No. 13/896,859, filed May 17, 2013.

William M. Scott, Pending, U.S. Appl. No. 29/431,415, filed Sep. 7, 2012.

William M. Scott, Pending, U.S. Appl. No. 29/431,416, filed Sep. 7, 2012.

William M. Scott, Pending, U.S. Appl. No. 29/431,417, filed Sep. 7, 2012.

William M. Scott, Pending, U.S. Appl. No. 13/606,059, filed Sep. 7, 2012.

William M. Scott, Pending, U.S. Appl. No. 29/431,504, filed Sep. 7, 2012.

William M. Scott, Pending, U.S. Appl. No. 29/431,507, filed Sep. 7, 2012.

William M. Scott, Pending, U.S. Appl. No. 13/673,246, filed Nov. 9, 2012.

William M. Scott, Pending, U.S. Appl. No. 29/436,876, filed Nov. 9, 2012.

William M. Scott, Pending, U.S. Appl. No. 29/436,882, filed Nov. 9, 2012.

* cited by examiner 162b
152b
135L
123
152a
162a
131L
152c
162c
32
122L
20c
121L
122
20
121
20b
20a
122R
20d
121R
131R
152f
162f
124
162d
135R
152e
162e
48
152d
49
47
41
46
47
48
152d
49
131R
152f
162f
32
124
162d
135R
152e
162e
122R
20d
121R
20b
20a
122
20
121
122L
20c
121L
135L
152b
162b
123
152a
162a
131L
152c
162c
32
135R
152e
162e
124
162d
131R
152f
162f
32
122R
20d
121R
20b
20a
122
20
121
122L
20c
121L
123
152a
162a
135L
152b
162b
131L
152c
162c
32
135L
152b
162b

CORRUGATED CONTAINER BOX AND BLANK

CROSS REFERENCE TO RELATED APPLICATIONS

This application claims the benefit of U.S. Provisional application 61/698,229, filed Sep. 7, 2012, the disclosure of which is incorporated by reference in its entirety.

FIELD OF THE INVENTION

The invention relates to box containers for storage and transportation of documents and other articles.

BACKGROUND OF THE INVENTION

Individuals and businesses across many industries use containers to store documents, materials, personal items, memorabilia, and the like. A common container for such use is a box, typically having a lid, typically made of a corrugated paperboard or cardboard. Such file boxes are used in the hundreds of millions to hold and store any and all sorts of items that can fit within them. Typically, these boxes carry up to forty pounds or more of materials within them.

In such previously known boxes the standard, slit handles or grips found in the container portion are well known. Conventional corrugated paperboard boxes having a handle opening and a lid have seen few changes since the introduction of that style of box over seventy years ago.

There are numerous circumstances where the use of a container box may want to prevent or deter other persons from accessing the contents of the box, after documents or other articles are placed inside the container box and a lid is placed over the top opening of the container. The contents placed into the box may include documents, articles, devices, or other things, related to a business, medical, personal or legal matter, that are used in businesses, offices, homes, home offices, and file storage facilities, and which may be of a confidential, secret, sensitive, personal, or private nature. In some circumstances, the user might want to have such documents, articles, etc. in a container with a lid that is securely closed and locked so that access by unauthorized persons is prevented, unless the lock or integrity of the box or lid is breached using a tool. However, in many situations, the user may want to deter access by an unauthorized person, or to provide some means of securing the lid in a closed position on the box that indicates tampering or breach of the securing means.

When a human user lifts and holds a commonly used and known corrugated box with handle or grip openings in the opposed sides, a number of changes immediately occur to that person's body. When the user holds that known box (or other containers similar to it) with her arms extended, the top of the box and/or lid of the box will lie at an angle (from horizontal) against the legs or lower torso of the holder. Because the box is weighted, the human user's center of gravity is shifted from her natural position within her body, to a point outside of her body to compensate for the box's weight. This shift of the user's center of gravity shifts the user's naturally weighted stance from her heels to the front of her feet and along her toes. Such orientation can be painful and is not sustainable over time. This is true because lifting and/or holding a container or box engages muscles in the back, arms, shoulders, torso, core, hips and legs. It also puts the holder in an unbalanced position that can cause slips or falls as a holder holds the box and moves with it. When the holder's center of gravity is shifted, her body operates instantly to counteract such shift and to support the weight pulling upon the front of her body. Such weight pull is compensated by most of the user's major muscle groups and in particular those about her lower back and torso.

Corrugated paperboard is the primary material used in the manufacture of document boxes. Corrugated material, like many construction materials, continually increase in price, and there remains a need to reduce the amount of material used in a container box, to reduce the amount of wasted material during the manufacture of the box, to reduce the amount of material used in the box, and to reduce the cost for making reduced-material container boxes.

SUMMARY OF THE INVENTION

The present invention provides a container comprising a box, the box comprising a bottom panel having a front edge, a rear edge, a right edge and a left edge; a first pair of opposed walls extending from the front edge and rear edges of the bottom panel; and a second pair of opposed walls extending from the right edge and left edge of the bottom panel; wherein either the first pair or the second pair of opposed walls each have an inner surface and comprise a first sidewall member having a first securement means and a second sidewall member comprising a second securement means that cooperates with the first securement means to secure the first sidewall member to the second sidewall member.

The present invention provides a container comprising a box, the box comprising a bottom panel having a front edge, a rear edge, a right edge and a left edge; a first pair of opposed walls extending from the front edge and rear edges of the bottom panel; and a second pair of opposed walls extending from the right edge and left edge of the bottom panel; wherein the first pair of opposed walls each have an inner surface and comprise a first sidewall member having a slot and a second sidewall member comprising an extending tab, wherein a portion of the extending tab of the second sidewall member extends through the slot of the first sidewall member to secure the first sidewall member to the second sidewall member.

The first pair of opposed walls can each further comprises a second sidewall consisting of a rectangular panel that forms the inner surface of each of the first pair of opposed walls. Both the first sidewall member and the second sidewall member can optionally have a grip opening in registry to form a through-wall grip opening for lifting and handling the box.

The present invention also relates to a blank formed on a single board for folding into a container, the blank comprising: a bottom panel having front, rear, right side and left side edges defined by corresponding fold lines on the blank, a front wall attached to the front edge of the bottom panel along the front fold line of the bottom panel, a rear wall attached to the rear edge of the bottom panel along the rear fold line of the bottom panel, a right sidewall attached to the bottom panel along the right side fold line of the bottom panel, the right sidewall having a front side edge defined by a corresponding front side edge fold line, and a rear side edge defined by a corresponding rear side edge fold line, a left sidewall attached to the bottom panel along the left side fold line of the bottom panel, the left sidewall having a front side edge defined by a corresponding front side edge fold line, and a rear side edge defined by a corresponding rear side edge fold line, a first front sidewall member attached to the front side edge fold line of one of the right sidewall and the left sidewall, the first front sidewall member being one of a slotted sidewall member having a slot or a tabbed sidewall member including an extending tab, and a second front sidewall member attached to the front side edge fold line of the other of the right sidewall and the left sidewall, the second front sidewall member being the other of the slotted sidewall member or the tabbed sidewall member, wherein at least a portion of the extending tab of the front tabbed sidewall member is configured to extend through the slot of the front slotted sidewall member in an assembled position, and a first rear sidewall member attached to the rear side edge fold line of one of the right sidewall and the left sidewall, the first rear sidewall member being one of a slotted sidewall member having a slot or a tabbed sidewall member including an extending tab, and a second rear sidewall member attached to the rear side edge fold line of the other of the right sidewall and the left sidewall, the second rear sidewall member being the other of the slotted sidewall member or the tabbed sidewall member, wherein at least a portion of the extending tab of the rear tabbed sidewall member is configured to extend through the slot of the rear slotted sidewall member in an assembled position.

The present invention also relates to a blank formed on a single board for folding into a container, the blank comprising: a bottom panel having front, rear, right side and left side edges defined by corresponding fold lines on the blank, a front wall attached to the front edge of the bottom panel along the front fold line of the bottom panel, a rear wall attached to the rear edge of the bottom panel along the rear fold line of the bottom panel, a right sidewall attached to the bottom panel along the right side fold line of the bottom panel, the right sidewall having a front side edge defined by a corresponding front side edge fold line, and a rear side edge defined by a corresponding rear side edge fold line, a left sidewall attached to the bottom panel along the left side fold line of the bottom panel, the left sidewall having a front side edge defined by a corresponding front side edge fold line, and a rear side edge defined by a corresponding rear side edge fold line, a front slotted sidewall member attached to the front side edge fold line of one of the right sidewall and the left sidewall, the front slotted sidewall member having a slot, and a front tabbed sidewall member including an extending tab, attached to the front side edge fold line of the other of the right sidewall and the left sidewall, wherein at least a portion of the extending tab of the front tabbed sidewall member is configured to extend through the slot of the front slotted sidewall member in an assembled position, and a rear slotted sidewall member attached to the rear side edge fold line of one of the right sidewall and the left sidewall, the rear slotted sidewall member having a slot, and a rear tabbed sidewall member including an extending tab, attached to the rear side edge fold line of the other of the right sidewall and the left sidewall, wherein at least a portion of the extending tab of the rear tabbed sidewall member is configured to extend through the slot of the rear slotted sidewall member in an assembled position.

The blank can optionally include a portion having a grip opening in both of the right sidewall and the left sidewall. Alternatively, the front wall and the rear wall can optionally include a top portion have a grip opening, wherein the front slotted sidewall member and the front tabbed sidewall member have a grip opening that each register with the grip opening of the front wall when the front wall is assembled, and wherein the rear slotted sidewall member and the rear tabbed sidewall member have a grip opening that each register with the grip opening of the rear wall when the rear wall is assembled.

An aspect of the present invention is a container box that is folded from a blank that is made from a single corrugated sheet of material, without the use glue or adhesive, or other means for attaching together two pieces of material, that uses at least 10% less material, and up to 25% (and more) less material, compared to conventional container boxes.

Another aspect of the present invention is a container box that is folded from a blank that is made from a single corrugated sheet of material, which is produced with significantly reduced waste, typically less than 5% waste material, including less than 1% waste material.

A further aspect of the present invention is a container box having a double-thickness wall that includes a continuous, smooth-surface inner sidewall and a two-piece compound outer sidewall.

Yet another aspect of the present invention is a container box having a continuous, smooth-surface bottom or floor that provides strength and integrity to the container box around the bottom.

Another aspect of the present invention is a container box that is folded from a blank that is intuitive to assemble, and includes a locking mechanism that prevents easy or spontaneous disassembly.

Yet another aspect of the present invention is a container box that can use up to 20-25% less material, while equivalent stacking strength to convention file boxes.

BRIEF DESCRIPTION OF THE DRAWINGS

While the specification concludes with claims particularly pointing out and distinctly claiming the invention, it is believed that the embodiments set forth herein will be better understood from the following description in conjunction with the accompanying figures, in which like reference numerals identify like elements and in which:

DETAILED DESCRIPTION OF THE INVENTION

Figure 1:
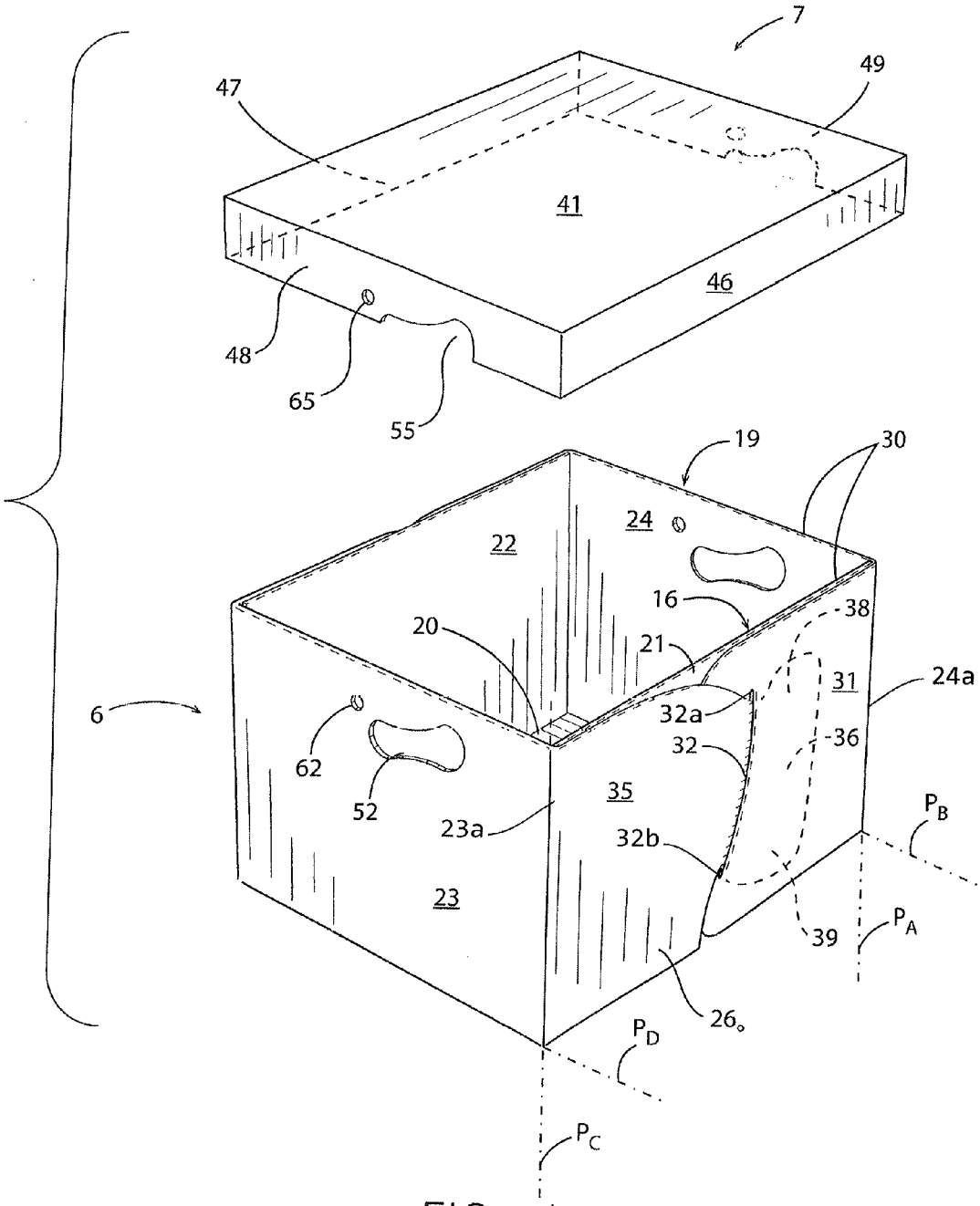
FIG. 1 is an exploded, perspective view of a container box and lid, the container box having opposed composite side walls, showing the lid removed from the top opening of the container box.

The term "grip" or "ergonomic grip" is defined herein as a fixed or moveable, permanent or temporary handle or grip, observation hole or opening, grip or any other opening or impression that could accommodate one or more figures of a human hand.

The term "height" is a distance or dimension determined in a direction perpendicular to a surface on which sets the bottom panel of the container, or bottom edge if the container does not have a bottom panel.

The term "width" is a distance or dimension determined in a lateral direction, perpendicular to the height.

The terms "front", "rear", "right" and "left" are relational terms for the orientation of the side surfaces of the container, wherein any one side surface of the container is denoted as "front", and the remaining side surfaces are accordingly denoted as "rear", "right" and left", when facing the front surface.

FIGS. 1 through 4 show a first embodiment of a container 5 that including an open-topped box 6, and an optional lid 7. The box 6 includes four rectangularly-arranged walls, including a front wall 16 and a rear wall 17, and left wall 18 and a right wall 19 disposed respectively between and attached to both the front wall and the rear wall. A floor 20 has a front edge joined to the bottom edge of the front wall 16, a rear edge joined to the bottom edge of the rear wall 17, a left edge joined to the bottom edge of the left wall 18, and a right edge joined to the bottom edge of the right wall 19. The upper edges of the four walls 16, 17, 18 and 19 define the top opening into the box.

The front wall 16 and the rear wall 17 form a first pair of opposed walls having substantially the same size and shape. The left wall 18 and the right wall 19 form a second pair of opposed walls, typically of the same size and shape. Left wall 18 consists of left sidewall 23 formed of a continuous, smooth rectangular material integral with and hinged to bottom 20 along its left side edge. Right wall 19 consists of right sidewall 24 formed of a continuous, smooth rectangular material integral with and hinged to bottom 20 along its right side edge.

Each of the walls the first pair of opposed walls 16 and 17 have an inner surface and an outer surface, and can include one, two, or more layers of board material. A layer of material can be a continuous, smooth, single piece of board material, or can be formed of a composite of two (or more) pieces of material. Wall 16 has an inner surface (not shown) and an outer surface 26*o*, and wall 17 has an inner surface 27*i* and an outer surface (not shown). Each of walls 16 and 17 includes a composite wall that comprises a first sidewall member having a first securement means, illustrated as a slotted sidewall member 31 having a slot 32, and a second sidewall member having a second securement means, illustrated as a tabbed sidewall member 35 comprising an extending tab 36. A portion of the extending tab 36 of the tabbed sidewall member 35 extends through the slot 32 of the slotted sidewall member 31, thereby cooperating with the slot to form a securement of the first or slotted sidewall member to the second or tabbed sidewall member.

It can be understood that other first and second securement means, and other types or arrangements of slots and tabs, can be employed as are known, for securing one wall member to another wall member to inhibit or prevent their separation from one another.

Figure 3:
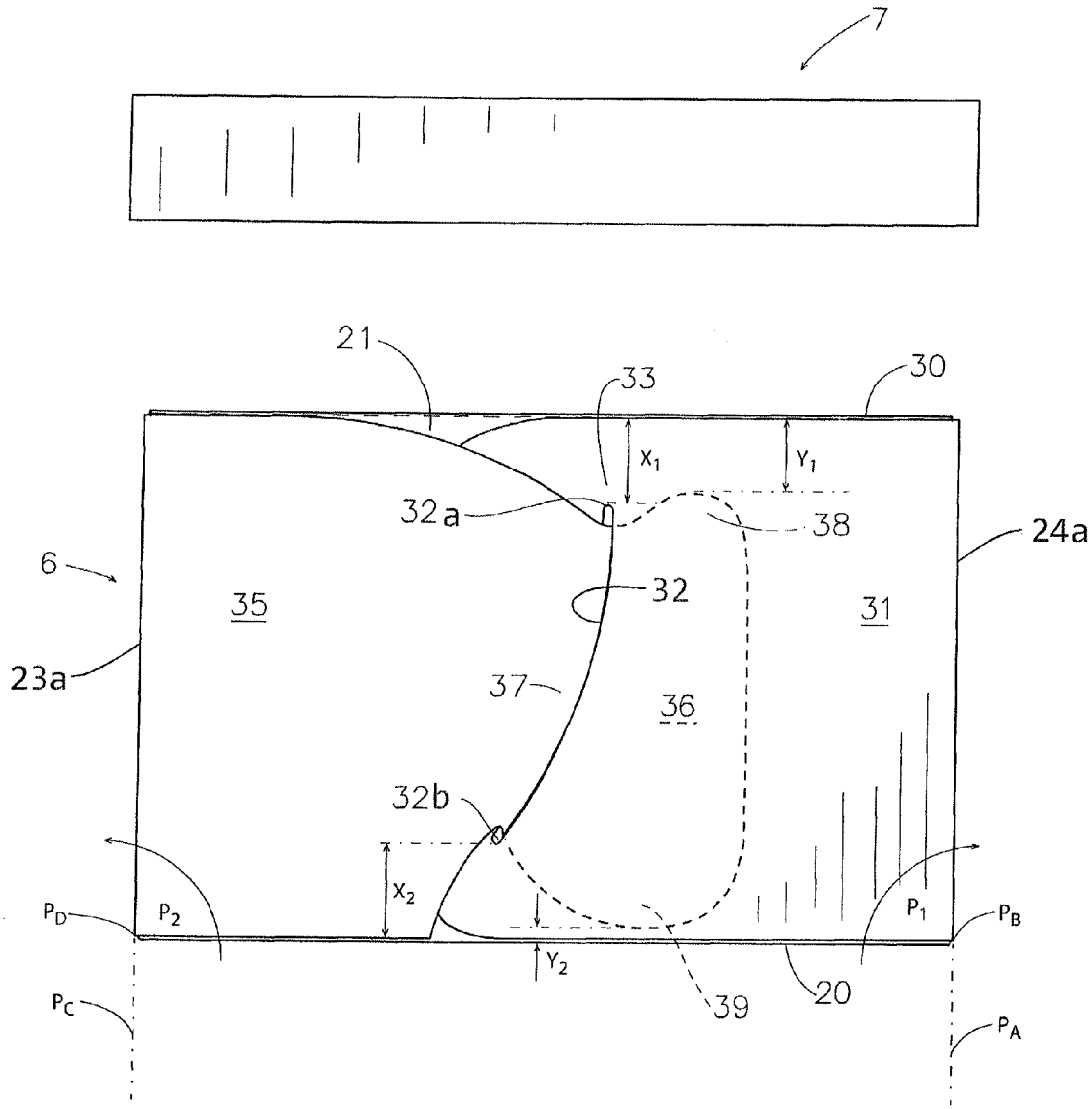
FIG. 3 is a side elevation view of the container box and lid of FIG. 1.

As shown in FIG. 3, the slot 32 extends through a portion of the height of the slotted sidewall member 31. The slot 32 can be oriented in a horizontal direction or a vertical direction, or therebetween, and can be straight or curvilinear. In the illustrated embodiment, the slot 32 is a curve formed substantially vertically in the sidewall 31, from an upper slot end 32*a* to a lower slot end 32*b*. The slot 32 continues from a distance "x1" from the top edge 30 to a distance "x2" from the bottom 20. An tab 36 of the tabbed sidewall member 35 extends horizontally (laterally) through the slot 32, and includes a portion or portions that also extend vertically above the top edge and below the bottom edge of the slot 32, toward the top end or bottom end of the container box, respectively. The tab 36 extends laterally from a neck 37 on the tabbed sidewall member 35, and includes at least one, or both, of an upper lobe 38 and a lower lobe 39. The upper lobe 38 can extend upward to a distance "y1" from the top edge 30. The lower lobe 39 can extend downward to a distance "y2" from the bottom 20.

The lower lobe 39 through the slot 32 extends a distance below the lower end of the slot 32 (the difference between the distances x2 and y2) that can be nil, or nominal (for example, a small distance, typically 0%-5% of the height of the wall 16,17), or up to a distance that is substantial (typically 15%-25% or more of the height of the wall 16,17), to provide easy assembly while also inhibiting or preventing the tab 36 from being pulled laterally away or pivoting out from the slot 32. Similarly, the upper lobe 38 extends through the slot 32 and extends a distance above the upper end of the slot 32 (the difference between the distances x1 and y1) that can be can be nil, or nominal (for example, a small distance, typically 0%-5% of the height of the wall 16,17), or up to a distance that is substantial (typically 15%-25% or more of the height of the wall 16,17), to provide easy assembly while also inhibiting or preventing the tab 36 from being pulled laterally away or pivoting out from the slot 32.

In the embodiment illustrated in FIG. 3, the lower lobe 39 extends below the lower end of the slot 32 (the difference between the distances x2and y2) a substantial distance, typically 15%-25% of the height of the wall 16,17, and the upper lobe 38 through the slot 32 extends above the upper end of the slot 32 (the difference between the distances x1and y1) a nil or nominal distance.

Figure 10:
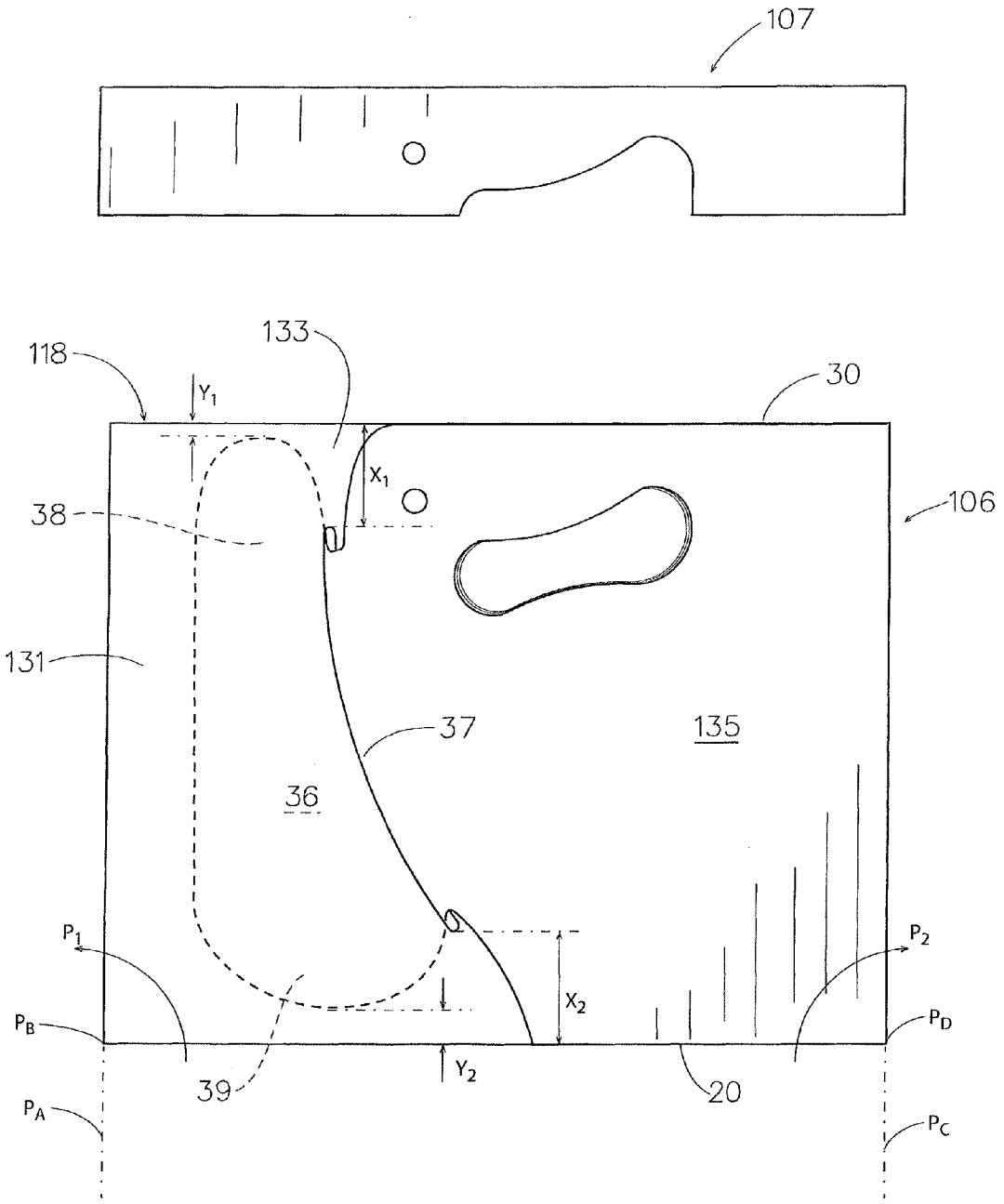
FIG. 10 is a side view of an alternative embodiment of a container box and lid, showing the lid removed from the top opening of the container box.

In an alternative embodiment illustrated in FIG. 10, lower lobe 39 through the slot 32 extends below the lower end of the slot a nil or nominal distance, while the upper lobe 38 through the slot 32 extends above the upper end of the slot a substantial distance. It can be understood that both the upper lobe and lower lobe can have vertical extension that are substantial distances beyond the edges of the slot toward the top edges 30 and bottom 20. In an embodiment wherein the upper lobe 38 has a substantial vertical extension, as shown in FIG. 10, the insertion of the upper lobe 38 of the tab 36 through the slot 32 can be aided by folding over a portion of the upper lobe 38 along a line, preferable near its extension from the neck 37, that preferably extends inwardly to aid insertion through the slot. Once inserted through the slot, the folded portion of the upper lobe 38 can be unfolded, thereby further inhibiting and preventing the tab 36 from being pulled laterally away or pivoting out from the slot 32.

The width and height of the sidewalls of the container are selected to ensure an overlap of the slotted sidewall member 31 with the tabbed sidewall member 35. The amount of overlap of the compound wall, formed by the slotted sidewall member 31 and the tabbed sidewall member 35, expressed as a percentage of the combined widths of the slotted sidewall member 31 and of the tabbed sidewall member 35, is typically at least 10%, including at least 15%, at least 20%, at least 25%, at least 30%, and at least 35%, and up to 100%, including up to 90%, up to 80%, up to 70%, up to 60%, up to 50%, up to 40%, up to 30% and up to 20%, and therebetween by units of 1%. In the illustrated embodiment wherein the compound wall is disposed over the wider end (wall 16) of the container box, the overlap percentage is about 22%. The percentage overlap of the compound wall when disposed on the narrower end of the container box is typically greater than when disposed on wider end. For example, in another embodiment of the invention wherein the compound wall is disposed over the narrower end of the container (wall 118 is FIG. 5), the overlap percentage is about 40%.

FIGS. 1 and 3 show that first sidewall member 31 is integral with and hinged to right sidewall 24 (right wall 19) along pivot line $P_A$, and right sidewall 24 is integral with and hinged to bottom 20 along its right side edge that defines a pivot line $P_B$, while second sidewall member 35 is integral with and hinged to left sidewall 23 (left wall 18) along pivot line $P_C$, and left sidewall 23 is integral with and hinged to bottom 20 along its left side edge that defines a pivot line $P_D$. Consequently, in the assembled configuration shown in FIG. 3, first slotted sidewall member 31 and second tabbed sidewall member 35 are fixed at and pivot away from one another at respective pivot points $P_B$ and $P_D$, as shown by arrows $P_1$ and $P_2$. Correspondingly, upper lobe 38 of second tabbed sidewall member 35 pivots into engagement with material of first slotted sidewall member 31 above slot 32, and visa versa, which inhibits the first and second sidewall members 31,35 from separating.

Each of front wall 16 and rear wall 17 also includes a second sidewall that is a continuous, smooth rectangular material. Second front sidewall 21 is integral with and hinged to bottom 20 along its front edge, and second rear sidewall 22 is integral with and hinged to bottom 20 along its rear edge. Second front sidewall 21 defines the inner surface 26*i* of the front wall 16, while second rear sidewall 22 defines the inner surface 27*i* of the rear wall 17, each presenting a smooth continuous surface to objects contained within the container box 6. All fold and attachment lines along the four sides of the bottom are continuous and uninterrupted with openings or gaps, presenting a clean interior bottom.

In an alternative embodiment, the compound wall can be disposed on the inner surface of the front wall 16 and rear wall 17.

Figure 2:
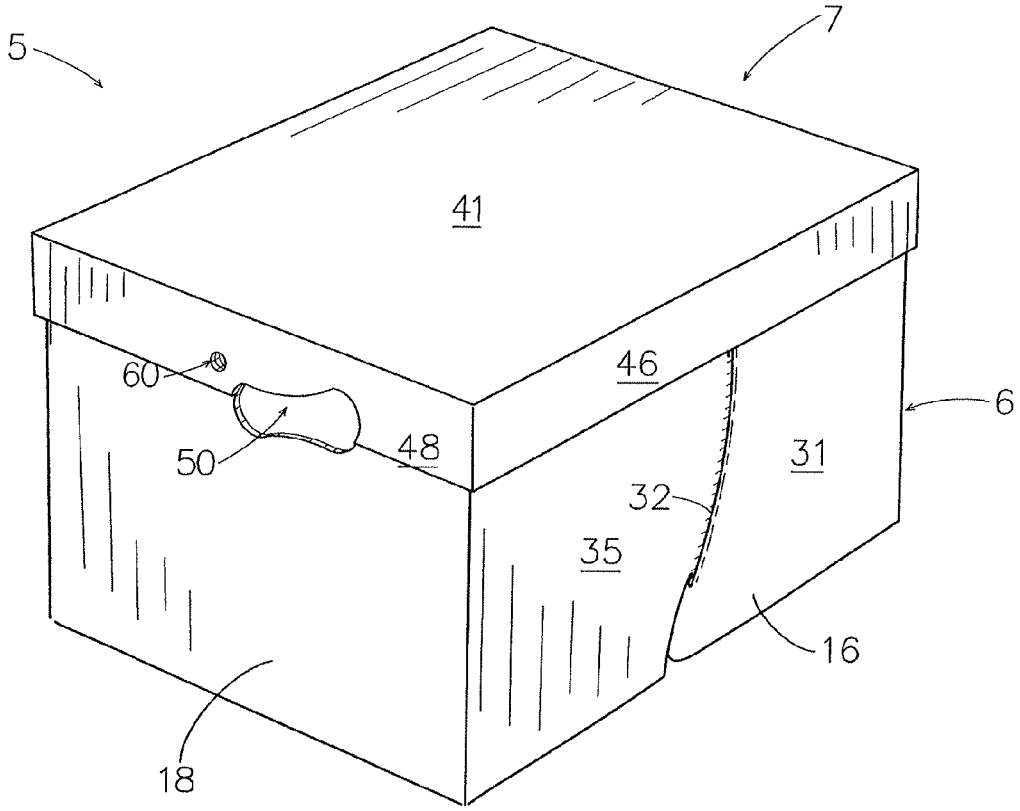
FIG. 2 is a perspective view of FIG. 1 showing the lid covering the container box.

An optional lid 7 is configured to fit over and cover the top opening and top edges 30 of the box 6. Lid 7 includes a top panel 41 that has a front edge joined to the top edge of a front panel 46, a rear edge joined to the top edge of a rear panel 47, a left edge joined to the top edge of a left panel 48, and a right edge joined to the top edge of a right panel 49. The opposed front panel 46 and rear panel 47 are disposed between and joined along common side edges to the left panel 48 and right panel 49 to form an inverted box lid, dimensioned so that the panels 46,47,48,49 of the lid 7 cover the top portions of the corresponding walls 16,17,18,19 of the container box 5, as shown in FIG. 2.

The container of the present invention can optionally include a grip or handle opening in the container box, and locking ports for securing the lid to the container box. The grip or handle opening can have a shape that can include rectangular, elliptical and oval. An example of a grip opening and through-lid grip opening is an ergonomically-shaped grip openings, including a grip opening described in International Patent Publication WO/2012/154763, the disclosure of which is incorporated by reference in its entirety. The illustrated container 5 has a through-lid grip opening 50 and a through-lid locking port 60, as shown in FIG. 2. The through-lid grip opening 50 is formed by the registry of a container grip opening 52 in the top portion of left wall 18 of the container box 6, and a lid grip opening 55 in the left panel 48 of the lid 7. The through-lid locking port 60 is formed by the registry of a container locking port 62 in the top portion of left wall 18 of the container box 6, and a lid locking port 65 in the left panel 48 of the lid 7. An opposed through-lid grip opening and through-lid locking port can be formed on the right side of the container 5 in the same manner. A center point of the through-lid grip opening is typically positioned at or near the lateral center point of the respective left and right walls.

The through-lid locking port is disposed proximate the through-lid grip opening, and provides therewith a pair of openings through the attached lid of the container 5 through which a locking means can be inserted and locked, for securing the lid 7 to the container 6. The locking means can include a strap seal or cable tie that can be passed through the through-lid grip opening and through-lid locking port and secured by well known means. A cable tie can include an elongated strap member having a distal end and a proximal end with an integrated open case having a ratchet. The strap member has a rack of teeth along its length. Pulling the distal end of the cable tie through the case and past the ratchet prevents the strap member from being pulled back out of the case. Typically, loop of the secured strap member has to be cut to remove the cable tie and unlock the lid from the box. Further details of a locking port for a container box and lid are described in U.S. Provisional Patent Application 61-649,231, filed May 18, 2012, the disclosure of which is incorporated by reference in its entirety.

Figure 4:
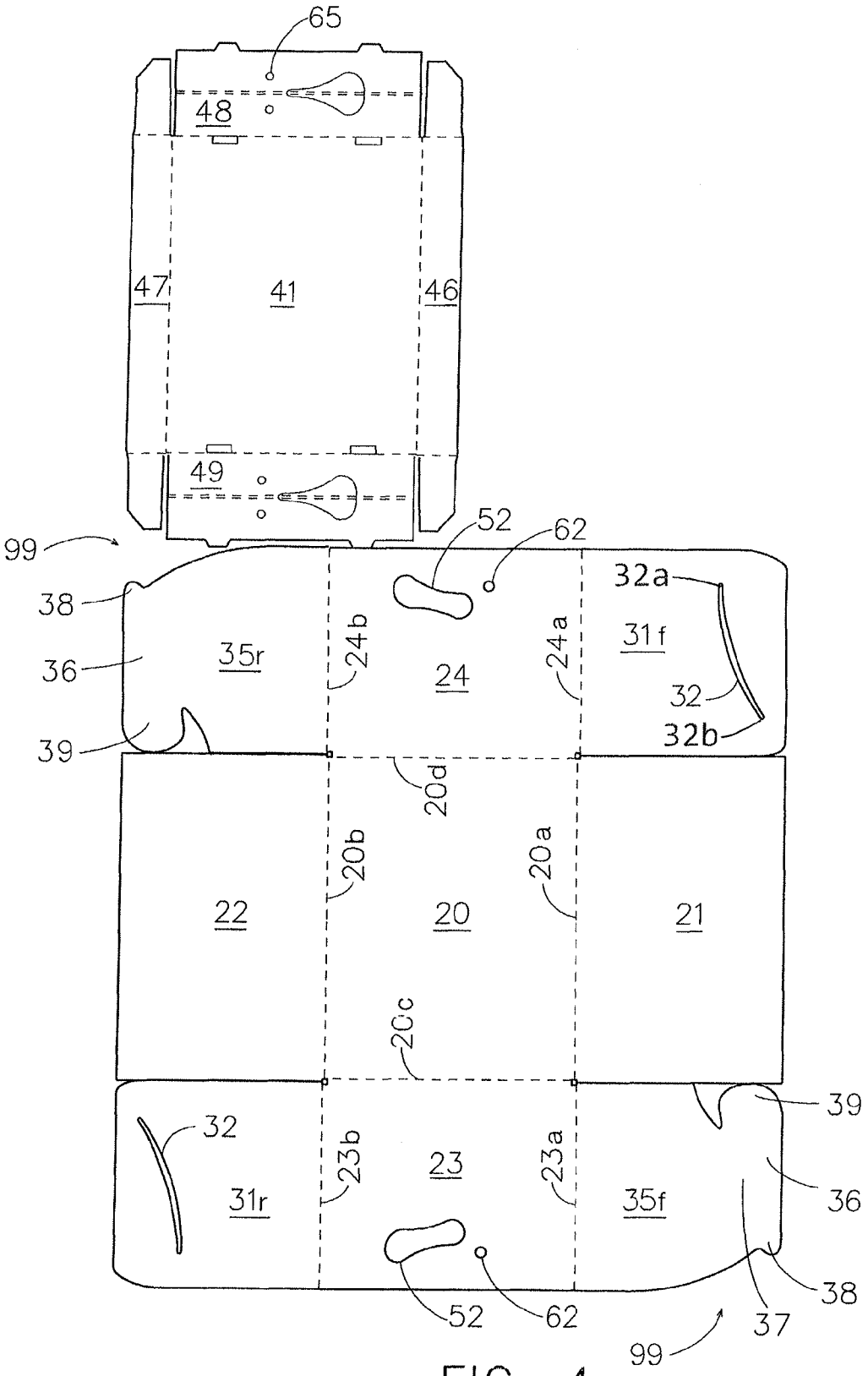
FIG. 4 is a plan view of the blank for folding into the container box and lid of FIG. 1.

FIG. 4 shows a blank 99 formed in a single board for folding into the container. The blank can also include a portion of board for folding into the lid. The portion for folding into the container is substantially square or rectangular, with very little void space (or board material cut away), including along the peripheral region of the blank. The lid portion of the blank is also substantially rectangular and attached to the container portion along one edge thereof. The lid portion is oriented to have a width dimension that is one half of at least one of the length or width of the container portion of the blank, to minimize board waste.

The blank comprises a bottom panel 20 having front, rear, right side and left side edges defined by corresponding front fold line 20*a*, rear fold line 20*b*, left side fold line 20*c*, and right side fold line 20*d* on the blank. A front sidewall 21 is attached to the bottom panel 20 along the front fold line 20*a* of the bottom panel, extending to a distal edge that defines the height of the front sidewall 21, and a rear sidewall 22 is attached to the bottom panel 20 along the rear fold line 20*b* of the bottom panel, extending to a distal edge that defines the height of the rear sidewall 22, which is typically the height of the front sidewall 21.

The blank also includes rectangularly-shaped left sidewall 23 attached to the bottom panel along the left side fold line 20*c* of the bottom panel 20, and extending to a distal edge that defines the height of the left sidewall 23, which is typically the height of the front sidewall 21. The left sidewall 23 has a front side edge, defined by a corresponding front side edge fold line 23*a*, from which extends frontwardly a front slotted sidewall member 31 f. The left sidewall 23 also has a rear side edge, defined by a corresponding rear side edge fold line 23*b*, from which extends rearwardly a rear tabbed sidewall member 35*r*. The front slotted sidewall 31*f* and the rear tabbed sidewall 35*r* each extend from their respective fold lines a distance that is the same height of the wall members, such as the height of the front sidewall 21.

The blank also includes rectangularly-shaped right sidewall 24 attached to the bottom panel 20 along the right side fold line 20*d* of the bottom panel, and extending to a distal edge that defines the height of the left sidewall 23, which is typically the height of the front sidewall 21. The right sidewall 24 has a front side edge, defined by a corresponding front side edge fold line 24*a*, from which extends frontwardly a front tabbed sidewall member 35*f*. The right sidewall 24 also has a rear side edge, defined by a corresponding rear side edge fold line 24*b*, from which extends rearwardly a rear slotted sidewall member 31*r*. The front tabbed sidewall 35*f* and the rear slotted sidewall 31*r* each extend from their respective fold lines a distance that is the same height of the wall members, such as the height of the front sidewall 21.

In the illustrated embodiment, the container portion of the blank is formed asymmetrically, such that the tabbed sidewall members 35 are disposed on the right side of the compound walls (front wall 16 and rear wall 17 in FIG. 1) and the slotted sidewall members 31 are disposed on the left side of the compound walls. In FIG. 4, the blank would appear identically if rotated in its own plane 180 degrees. It can be understood that the blank can be formed conversely, with the tabbed sidewall members 35 disposed on the left side and slotted sidewall members 31 disposed on the right side, and that the blank, and corresponding container box, can be formed symmetrically about a center axis. For example, both of the tabbed sidewall members 35 could extend forwardly from the corresponding left sidewall 23 and right sidewall 24, and both of the slotted sidewall members 31 could extend rearwardly from the corresponding left sidewall 23 and right sidewall 24, or visa versa.

The front and rear slotted sidewall members 31 comprise a substantially rectangular-shaped base portion having a curved slot 32 penetrating through a distal end of the base portion. The slot can also be a linear slot. The length of the slot is sized to accommodate a tab, described hereinafter.

The front and rear tabbed sidewall members 35 comprise a substantially rectangular-shaped base portion that tapers abruptly to a narrowed neck portion 37, and includes a tab 36 extending from the neck portion 37. The tab 36 is configured to pass through the slot and to engage the material of the slotted sidewall members 31 to retain engagement of the tab 36 within the slot 32. The tab 36 includes at least one lobe that extends laterally along the respective front or rear side edge fold line, and preferably includes a pair of lobes 38,39.

As shown in FIG. 4, the blank can also include a portion of the single board for folding into the lid, which can be separated from the container portion of the blank for folding and assembly.

It can be understood that the embodiment shown in FIG. 1-4 can be described wherein walls 16 and 17 are defined as right and left walls, and walls 18 and 19 are defined as front and real walls.

FIGS. 5 through 9 show a second embodiment of a container 105 that includes an open-topped box 106 and a lid 7, wherein like reference numerals are used to describe elements described herein above for the first embodiment. The box 106 includes four rectangularly-arranged walls, including a front wall 116 and a rear wall 117, and left side wall 118 and a right side wall 119 disposed respectively between and attached to both the front wall and the rear wall. A floor 20 has a front edge joined to the bottom edge of the front wall 116, a rear edge joined to the bottom edge of the rear wall 117, a left edge joined to the bottom edge of the left side wall 118, and a right edge joined to the bottom edge of the right side wall 119. The upper edges of the four walls 116, 117, 118 and 119 define the top opening into the box.

Figure 12:
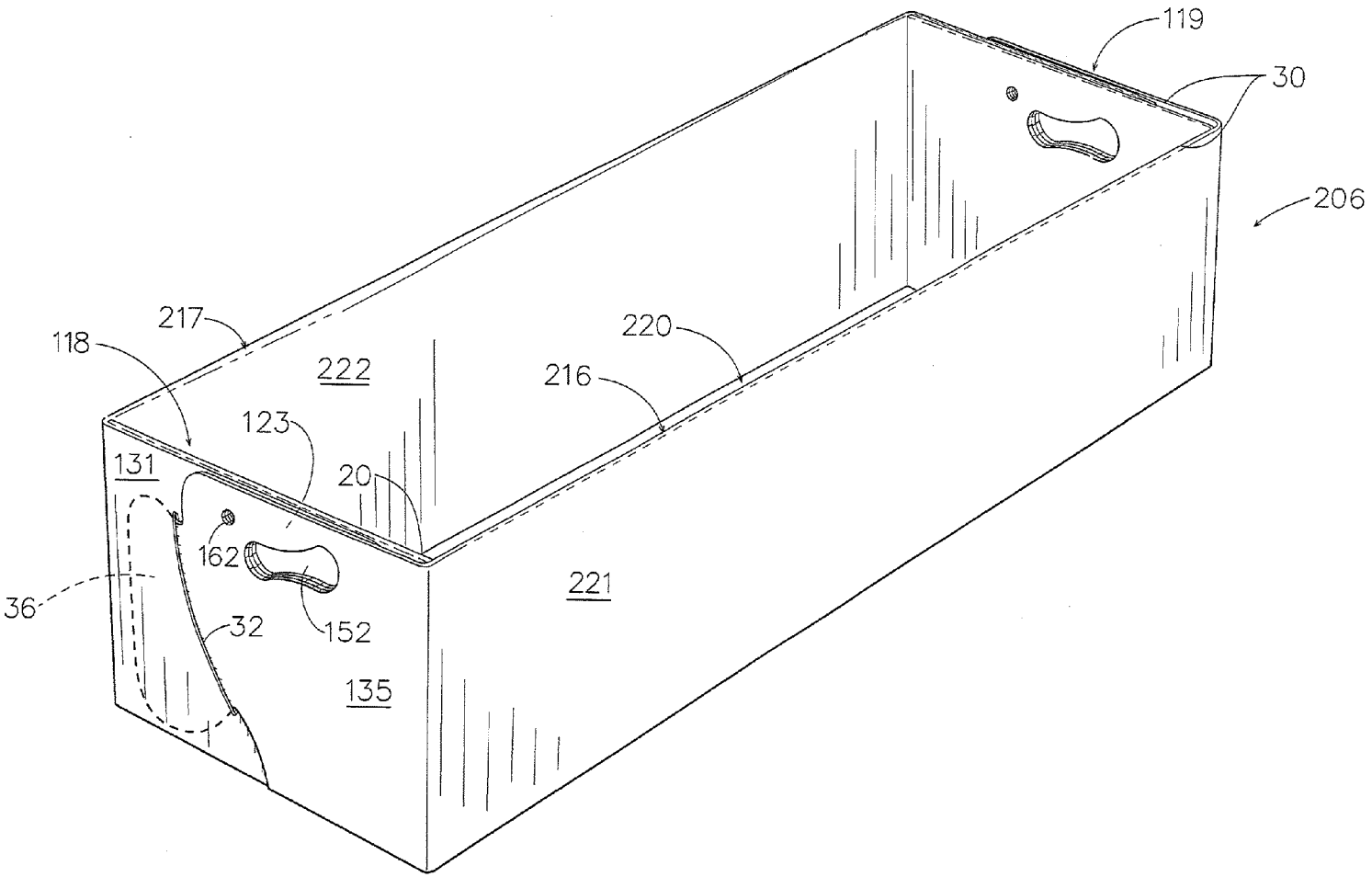
FIG. 12 shows an alternative embodiment of the container box and lid of FIG. 5

The front wall 116 and the rear wall 117 form a first pair of opposed walls having substantially the same size and shape. The left side wall 118 and the right side wall 119 form a second pair of opposed walls, typically of the same size and shape. Front wall 116 consists of front sidewall 121 formed of a continuous, smooth substantially rectangular material integral with and hinged to bottom 20 along its front edge. Rear wall 117 consists of rear sidewall 122 formed of a continuous, smooth substantially rectangular material integral with and hinged to bottom 20 along its rear edge. The front sidewall 116 and rear sidewall 117 are illustrated as about the width of the side walls 118 and 119. Also within the scope of the invention are front sidewall 116 and rear sidewall 117 that are substantially wider than the side walls 118 and 119, including at least twice as wide, at least three times as wide, and at least four times as wide. FIG. 12 illustrates a container box 206 that is similar in design to the container box 106 of FIG. 5, with an elongated bottom 220, elongated front and rear sidewalls 221 and 222, to provide an elongated container box, as shown in FIG. 12.

Each of the walls the second pair of opposed walls 118 and 119 have an inner surface and an outer surface, and can include one, two, or more layers of board material. A layer of material can be a continuous, smooth, single piece of board material, or can be formed of a composite of two (or more) pieces of material. Left wall 118 has an inner surface (not shown) and an outer surface 126*o*, and right wall 119 has an inner surface 127*i* and an outer surface (not shown). Each of walls 118 and 119 includes a composite wall that comprises a first slotted sidewall member 131 having a slot 32, and a second sidewall member 135 comprising an extending tab 36. A portion of the extending tab 36 of the second or tabbed sidewall member 135 extends through the slot 32 of the first or slotted sidewall member 131.

Figure 6:
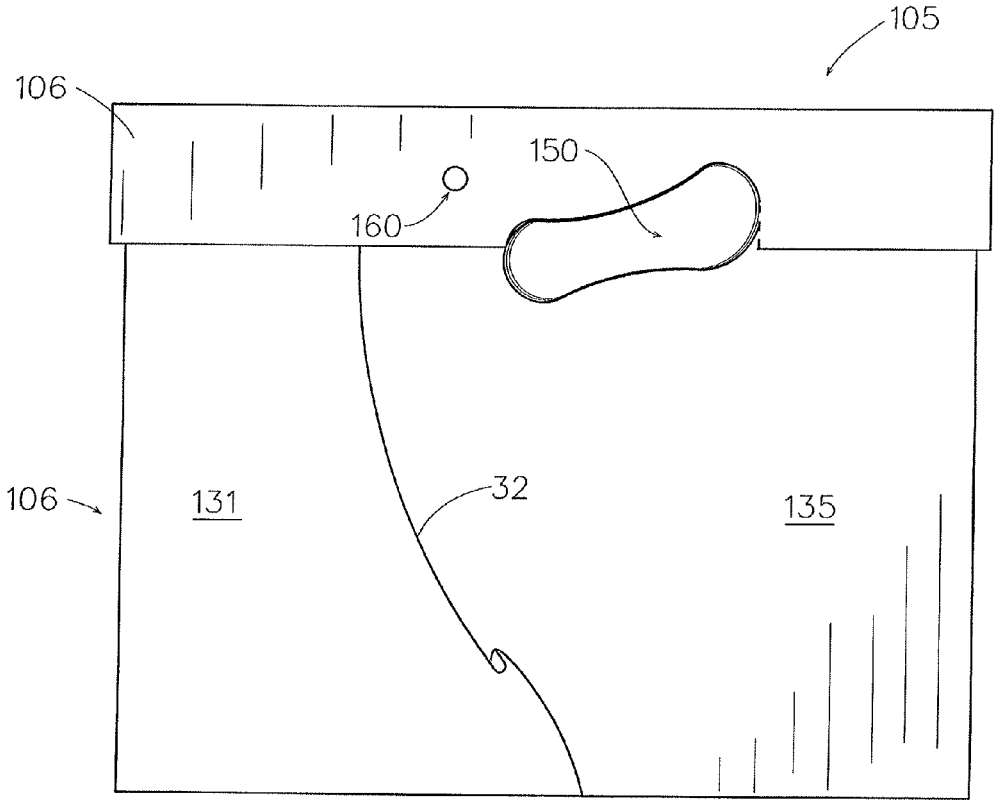
FIG. 6 is a side view of the container box and lid of FIG. 5, with the lid covering the top opening of the container box.
Figure 7:
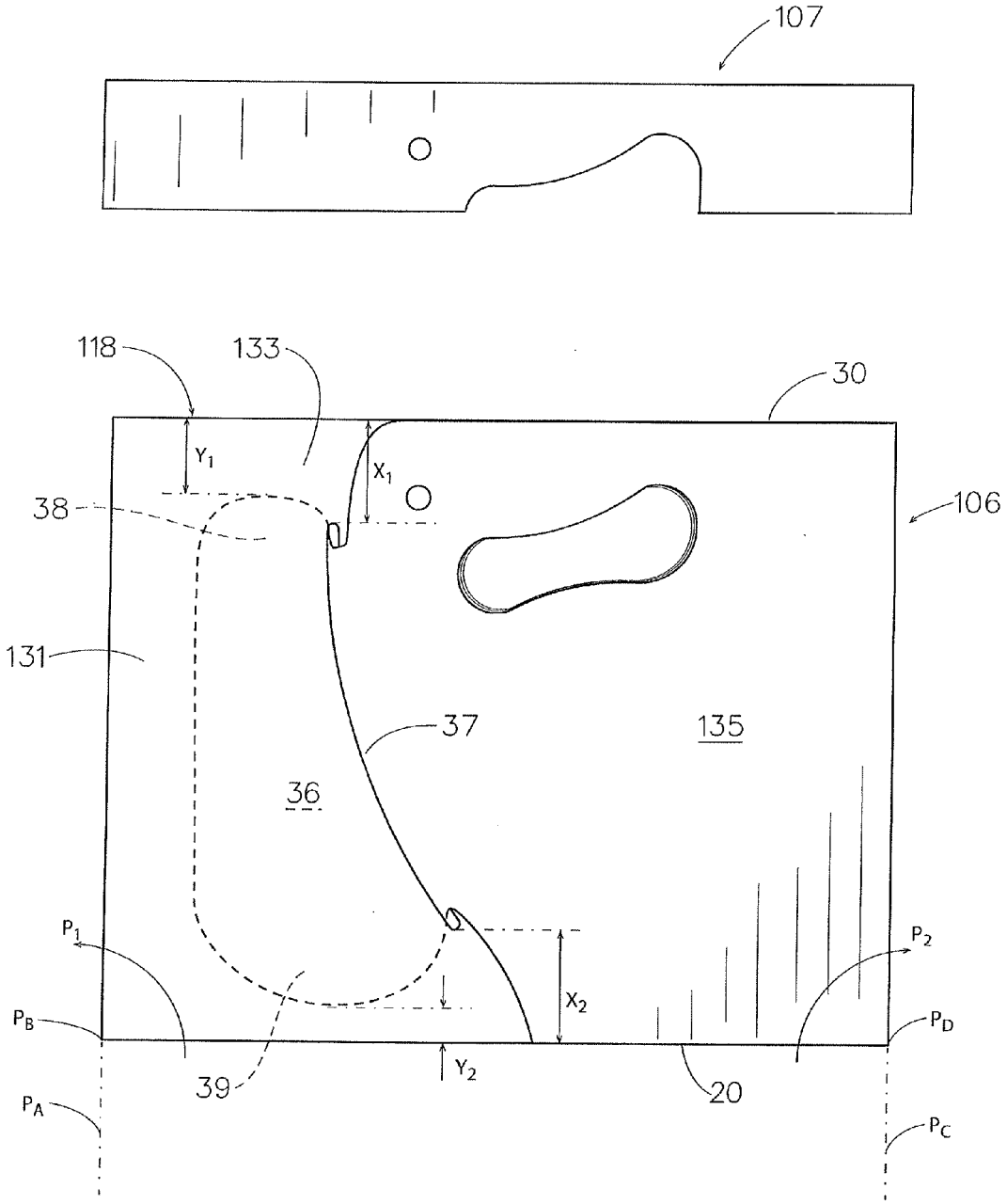
FIG. 7 is a side view of the container box and lid of FIG. 5, showing the lid removed from the top opening of the container box.

As shown in FIGS. 6 and 7, the slot 32 extends through a portion of the height of the slotted sidewall member 131, from a distance "x1" from the top edge 30 to a distance "x2" from the bottom 20. The tab 36 extends laterally from a neck 37 on the second sidewall member 135, and includes upper lobe 38 that extends upward to a distance "y1" from the top edge 30, and a lower lobe 39 that extends downward to a distance "y2" from the bottom 20. The lower lobe 39 through the slot 32 extends a distance below the lower end of the slot 32 (the difference between the distances x2and y2) that is a substantial distance (typically 15%-25%, or more of the height of the wall 18,19), while upper lobe 38 through the slot 32 extends a distance above the upper end of the slot 32 (the difference between the distances x1and y1) that is nil or only a small distance, typically 0%-5% of the height of the wall 18,19, to provide easy assembly while inhibiting the second tabbed sidewall member 135 from being pulled laterally away from the first slotted sidewall member 131. As described herein earlier and shown in FIG. 10, the upper lobe 38 can be configured to extend higher above the upper end of the slot, to improve the securement for the tabbed sidewall member to the slotted sidewall member.

Figure 5:
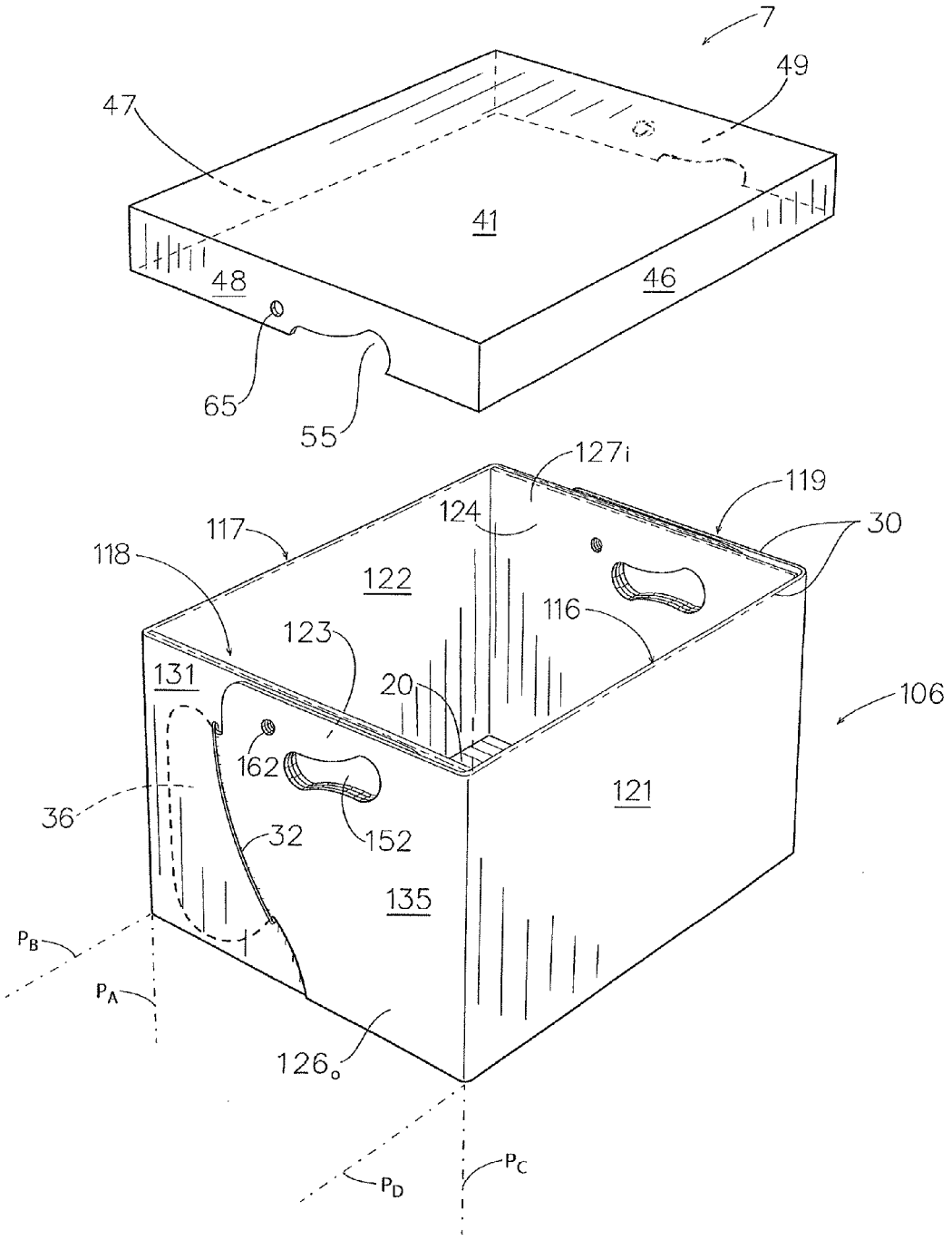
FIG. 5 is an exploded, perspective view of another embodiment of a container box and lid, the container box having opposed composite side walls.

FIGS. 5-7 show that first sidewall member 131 is integral with and hinged to rear sidewall 122 (rear wall 117) along pivot line $P_A$, and rear wall 117 is integral with and hinged to bottom 20 along its rear edge that defines a pivot line $P_B$, while second sidewall member 135 is integral with and hinged to front sidewall 121 (front wall 116) along pivot line $P_C$, and front sidewall 121 (front wall 116) is integral with and hinged to bottom 20 along its front edge that defines a pivot line $P_D$. Consequently, in the assembled configuration shown in FIG. 6, first, slotted sidewall member 131 and second, tabbed sidewall member 135 are fixed at and pivot away from one another at and around respective pivot points $P_B$ and $P_D$, as shown by arrows $P_1$ and $P_2$. Correspondingly, upper lobe 38 of tabbed panel member 135 pivots into engagement with material 133 of first slotted sidewall member 131 above slot 32, and visa versa, which inhibits the first and second sidewall members 131,135 from separating.

Each of left wall 118 and right wall 119 also includes a second sidewall that is a continuous, smooth rectangular material. Second left sidewall 123 is integral with and hinged to bottom 20 along its left side edge, and second right sidewall 124 is integral with and hinged to bottom 20 along its right side edge. Second left sidewall 123 defines the inner surface of the left wall 118, while second right sidewall 124 defines the inner surface 127*i* of the right wall 119, each presenting a smooth continuous surface to objects contained within the container box 6.

In an alternative embodiment, the compound wall can be disposed on the inner surface of the left wall 118 and right wall 119.

An optional lid 7 is configured to fit over and cover the top opening and top edges 30 of the box 6. Lid 7 includes a top panel 41 that has a front edge joined to the top edge of a front panel 46, a rear edge joined to the top edge of a rear panel 47, a left edge joined to the top edge of a left panel 48, and a right edge joined to the top edge of a right panel 49. The opposed front panel 46 and rear panel 47 are disposed between and joined along common side edges to the left panel 48 and right panel 49 to form an inverted box lid, dimensioned so that the panels 46,47,48,49 of the lid 7 cover the top portions of the corresponding walls 116,117,118,119 of the container box 105.

Figure 8:
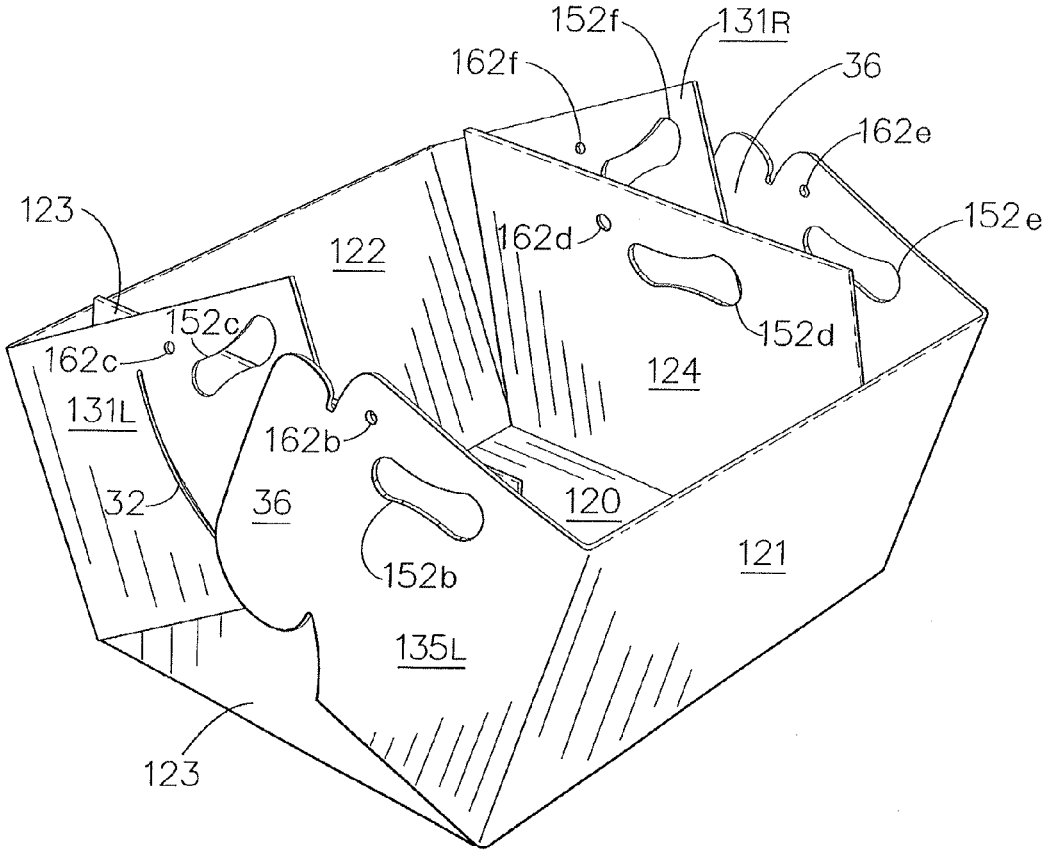
FIG. 8 is a perspective view of the container box of FIG. 5, with the container walls partially disassembled.

The container 105 has a through-lid grip opening 150 and a through-lid locking port 160, as shown in FIG. 6. The through-lid grip opening 150 is formed by the registry of a container grip opening 152 in the top portion of left wall 118 of the container box 6, and a lid grip opening 55 in the left panel 48 of the lid 7. The container grip opening 152 in the left wall 118 is formed by the registry of grip opening 152*a* in left sidewall 123, and the grip openings 152*b* and 152*c* in the slotted sidewall member 131 and the tabbed sidewall member 135, respectively, as shown in FIG. 8.

The through-lid locking port 160 is formed by the registry of a container locking port 162 in the left wall 118 of the container box 106, and a lid locking port 65 in the left panel 48 of the lid 7. The container locking port 162 in the left wall 118 is formed by the registry of locking port 162*a* in left sidewall 123, and the locking ports 162*b* and 162*c* in the slotted sidewall member 131 and the tabbed sidewall member 135, respectively, as shown in FIG. 8.

An opposed through-lid grip opening and through-lid locking port can be formed on the right side of the container 5 in the same manner. A center point of the through-lid grip opening is typically positioned at or near the lateral center point of the respective left and right walls.

Figure 9:
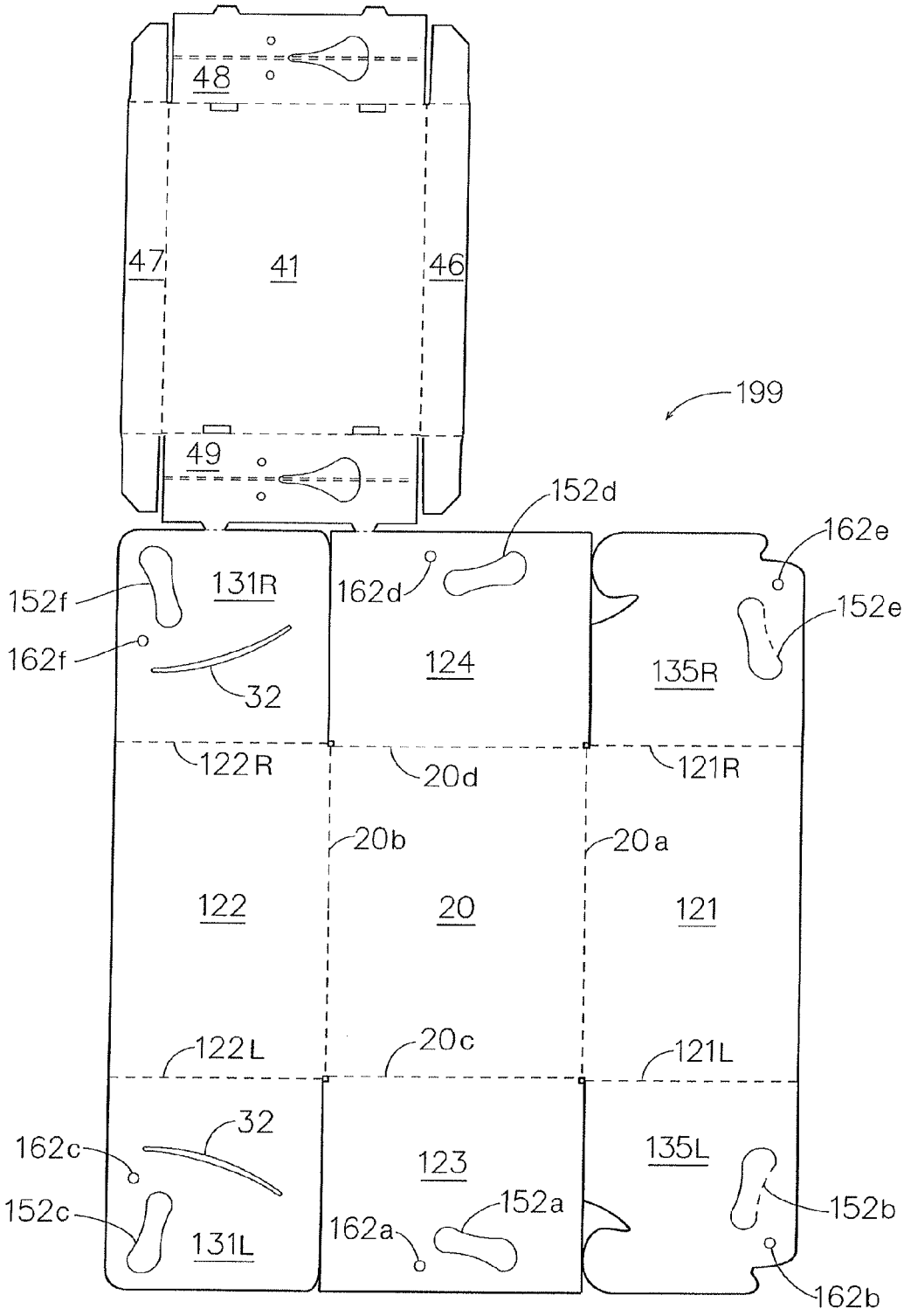
FIG. 9 is a plan view of the blank for folding into the container box and lid of FIG. 5.

FIG. 9 shows a blank 199 formed in a single board for folding into the container. The blank comprises a bottom panel 20 having front, rear, right side and left side edges defined by corresponding front fold line 20*a*, rear fold line 20*b*, left side fold line 20*c*, and right side fold line 20*d* on the blank. A front wall 121 is attached to the bottom panel 20 along the front fold line 20*a* of the bottom panel, extending to a distal edge. The front wall 121 has a left side edge, defined by a corresponding left side edge fold line 121L, from which extends leftwardly a left tabbed sidewall member 135L. The front wall 121 also has a right side edge, defined by a corresponding rear side edge fold line 121R, from which extends rightwardly a right tabbed sidewall member 135R.

A rear wall 122 is attached to the bottom panel 20 along the rear fold line 20*b* of the bottom panel, extending to a distal edge. The rear wall 122 has a left side edge, defined by a corresponding left side edge fold line 122L, from which extends leftwardly a left slotted sidewall member 131L. The rear wall 122 also has a right side edge, defined by a corresponding rear side edge fold line 122R, from which extends rightwardly a right slotted sidewall member 131R.

The blank also includes rectangularly-shaped left sidewall 123 attached to the bottom panel along the left side fold line 20*c* of the bottom panel 20, and extending to a distal edge, and rectangularly-shaped right sidewall 124 attached to the bottom panel 20 along the right side fold line 20*d* of the bottom panel, and extending to a distal edge.

The left and right slotted sidewall members 131L and 131R comprise a substantially rectangular-shaped base portion having a curved slot 32 penetrating through a distal end of the base portion. The slot can also be a linear slot. The length of the slot is sized to accommodate a tab, described hereinafter.

The left and right tabbed sidewall members 135L and 135R comprise a substantially rectangular-shaped base portion that tapers to a narrowed neck portion 37, and includes a tab 36 extending from the neck portion 37. The tab 36 is configured to pass through the slot and to engage the material of the slotted sidewall members 131 to retain engagement of the tab 36 within the slot 32. The tab 36 includes at least one lobe that extends laterally along the respective front or rear side edge fold line, and preferably includes a pair of lobes 38,39.

Figure 11:
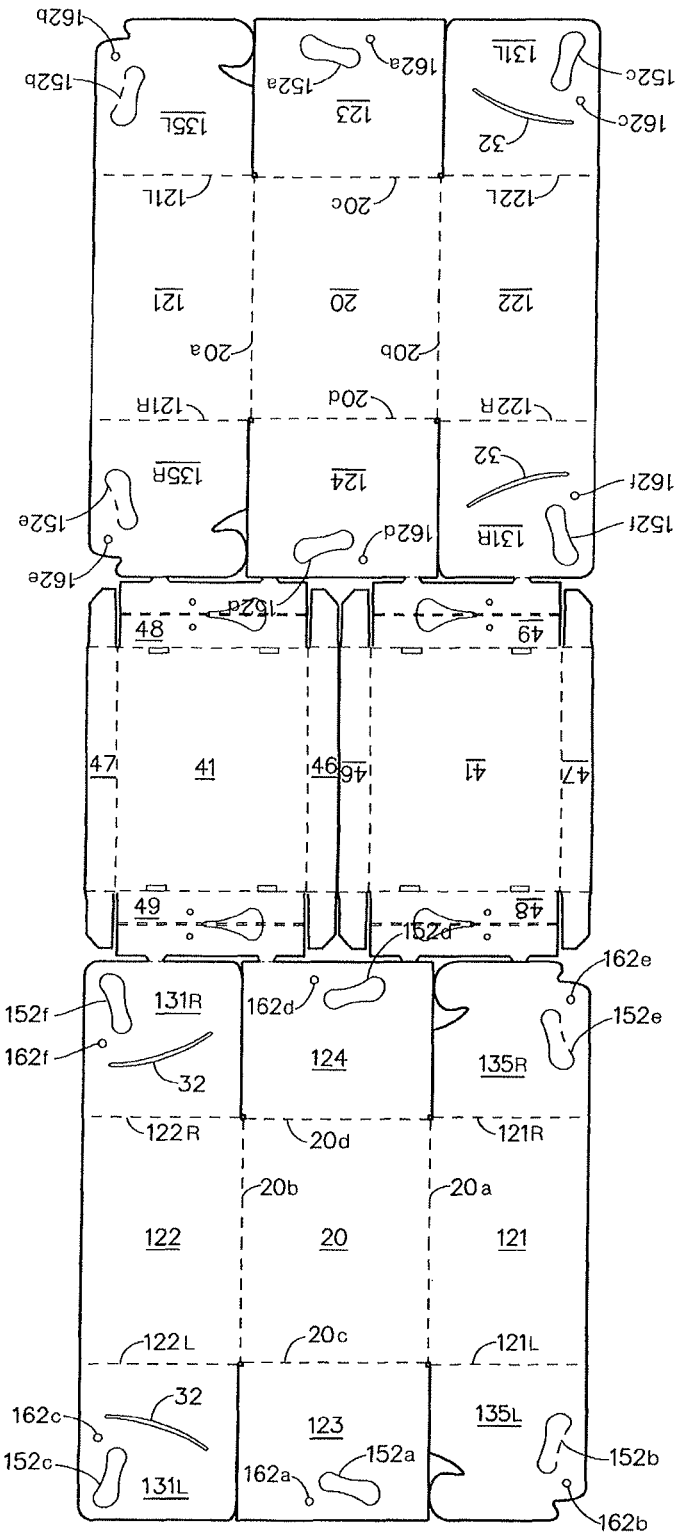
FIG. 11 is a plan view of a pair of blanks shown in FIG. 9, arranged for production together in a single die.

As shown in FIG. 9, the blank can also include a lid portion for folding into the lid. The lid portion of the blank is substantially rectangular and attached to the container portion along one edge thereof. The lid portion is oriented to have a width dimension that is one half of at least one of the length or width of the container portion of the blank, to minimize board waste. FIG. 11 shows orientation of a pair of container-lid blanks, with the two lid blank portions disposed side-by-side and separating the two container blank portions, for producing two container-lids together in a single die and using carton board material efficiently in production.

An alternative embodiment of the container box of the present invention is a container box as described herein, with a hinged lid. The integral construction can comprise a permanent or semi-permanent attachment of a side panel of a lid to the top portion of the sidewall, such as by adhesive attachment, or can comprise forming both the lid and the sidewall from the same blank of corrugated material. An example of an integral lid having an extending side panel with an inner surface that is attached, typically adhesively, to the outer surface of the top portion of the sidewall is shown in International Patent Publication WO2012/154763, the disclosure of which is incorporated herein by reference.

Figure 13:
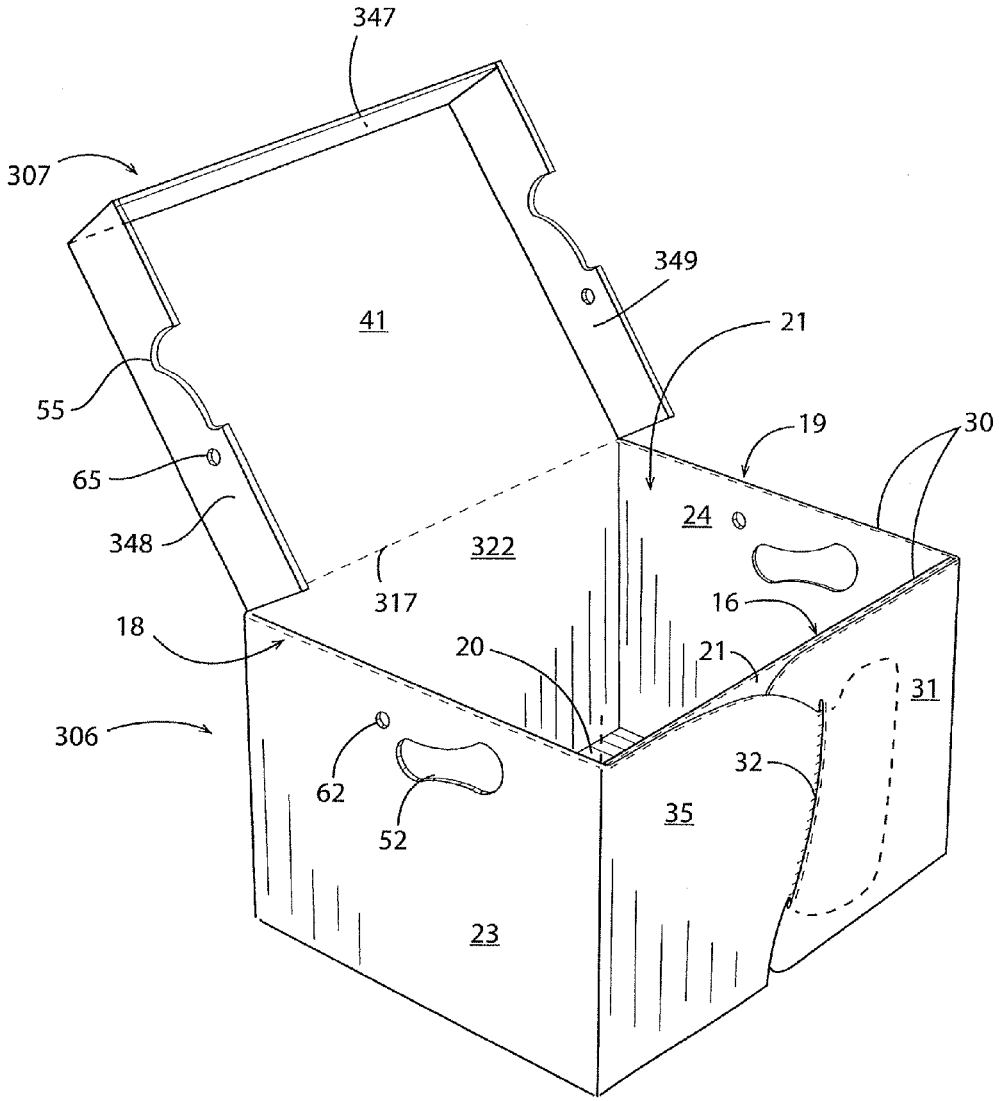
FIG. 13 shows an embodiment a container box of the invention with an integral lid.
Figure 14:
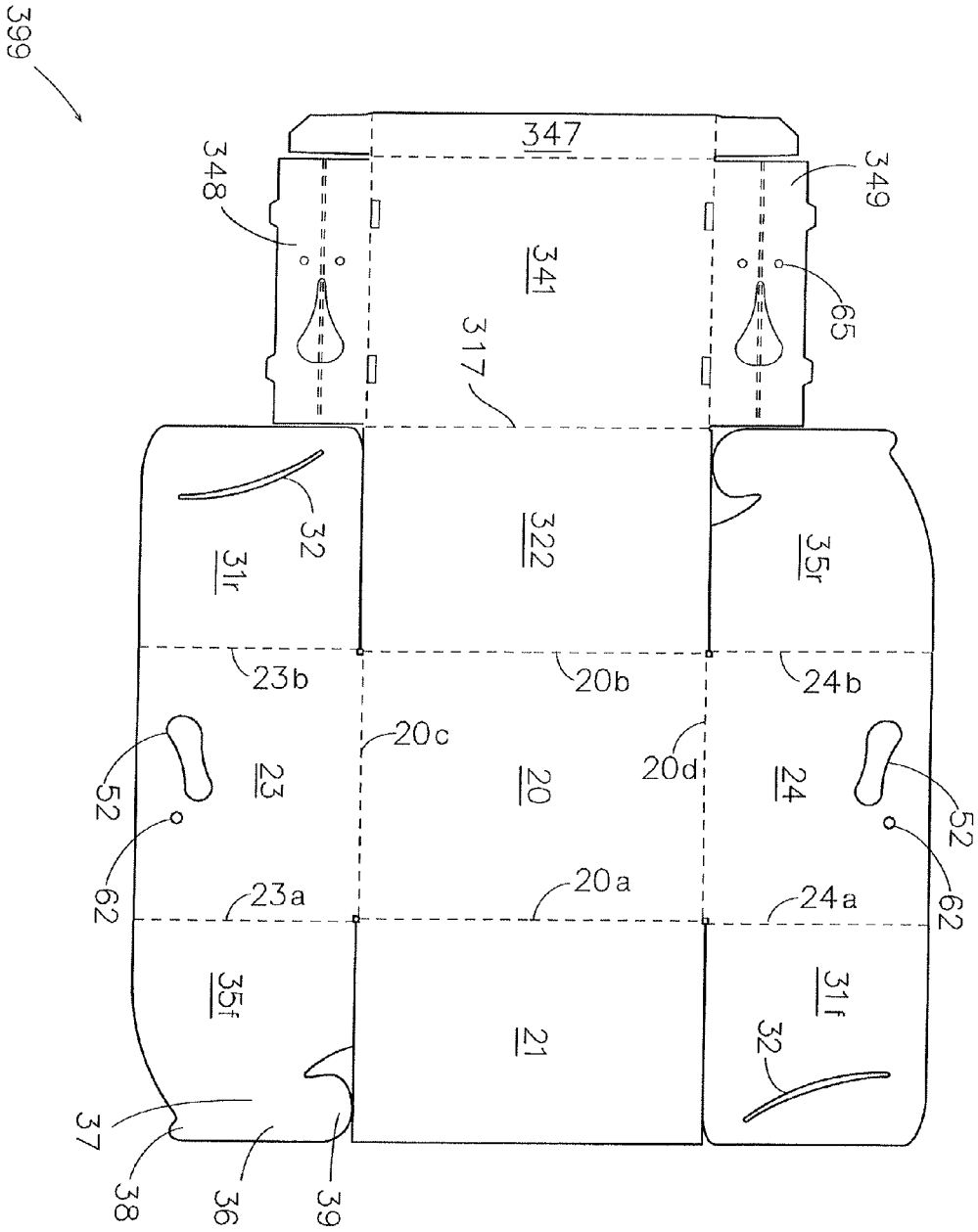
FIG. 14 is a plan view of a blank for folding into the container box and lid of FIG. 12.

FIG. 13 illustrates an embodiment of a container box 306 with an integral lid 307, the integral lid 307 extending from sidewall 322 of the container body. The integration of the lid 307 with the container body provides a hinged connection 317 so that the lid 307 can be folded back from and over the opening 321 of the container body. FIG. 14 illustrates a plan view of a blank 399 for folding into the container box and lid of FIG. 12.

Another embodiment of a container box and lid combines the elongated container box 206 described herein and shown in FIG. 12, with an integral lid as described and shown in FIG. 13.

FIG. 14 shows a blank 399 formed in a single board for folding into the container. The blank 399 is similar to the blank 99 of FIG. 4, except that the portion of board for folding into a lid includes top panel 341 that extends hingedly from the upper edge 317 of the sidewall 222.

An alternative embodiment of the container can include two or more through-lid locking ports formed into adjacent corners of the lid along the common edge.

A further embodiment of the invention is a container box 206 having outwardly tapered sidewalls 216 and 217, and/or front and back walls 218 and 219, providing a top opening 230 that has an open area and dimension larger than those of the bottom 220.

Figure 15:
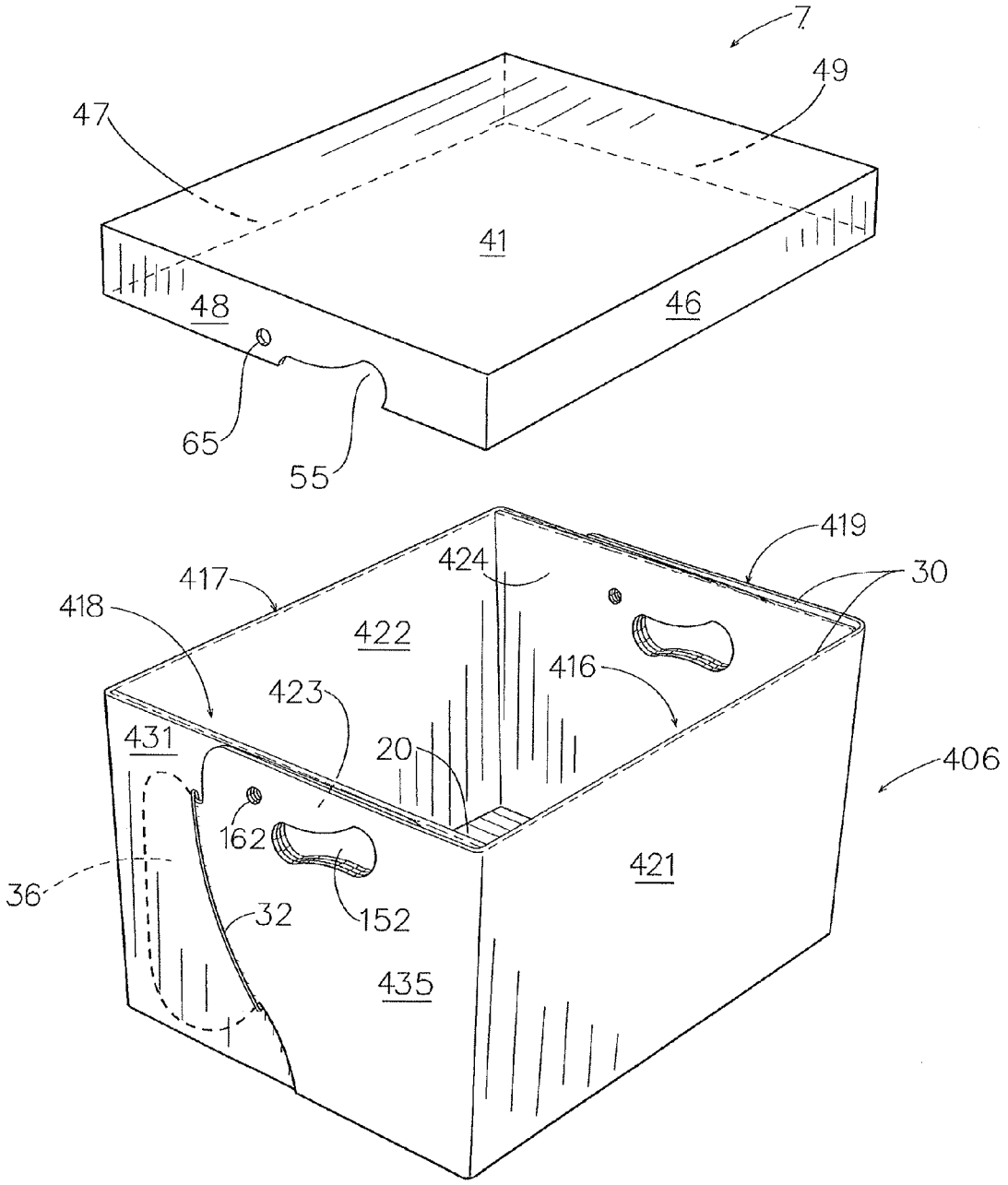
FIG. 15 shows an embodiment a container box of the invention with sidewalls that outwardly taper.

Another embodiment of the container box of the present invention provides a container box having sidewalls and end-walls that taper outwardly from the bottom. FIG. 15 shows a container that includes an open-topped box 406 and a lid 7, wherein like reference numerals are used to describe elements described herein above for the second embodiment. The box 406 includes four rectangularly-arranged walls, including a front wall 416 and a rear wall 417, and left side wall 418 and a right side wall 419 disposed respectively between and attached to both the front wall and the rear wall, and a floor 20. The front wall 416 and the rear wall 417 form a first pair of opposed walls having substantially the same size and shape, each having opposed side edges that taper outwardly from bottom to top. The left side wall 418 and the right side wall 419 form a second pair of opposed walls, typically of the same size and shape, each also having opposed side edges that taper outwardly from bottom to top. Front wall 416 consists of front sidewall 421 formed of a continuous, smooth substantially rectangular material integral with and hinged to bottom 20 along its front edge. Rear wall 417 consists of rear sidewall 422 formed of a continuous, smooth substantially rectangular material integral with and hinged to bottom 20 along its rear edge.

Each of the walls the second pair of opposed walls 418 and 419 have an inner surface and an outer surface, and can include one, two, or more layers of board material. A layer of material can be a continuous, smooth, single piece of board material, or can be formed of a composite of two (or more) pieces of material. Each of walls 418 and 419 includes a composite wall that comprises a first slotted sidewall member 431 having a slot 32, and a second sidewall member 435 comprising an extending tab 36. A portion of the extending tab 36 of the second or tabbed sidewall member 435 extends through the slot 32 of the first or slotted sidewall member 431.

The opposed pairs of sidewalls provide a top opening that is large than the bottom 20, resembling a tote.

Figure 16:
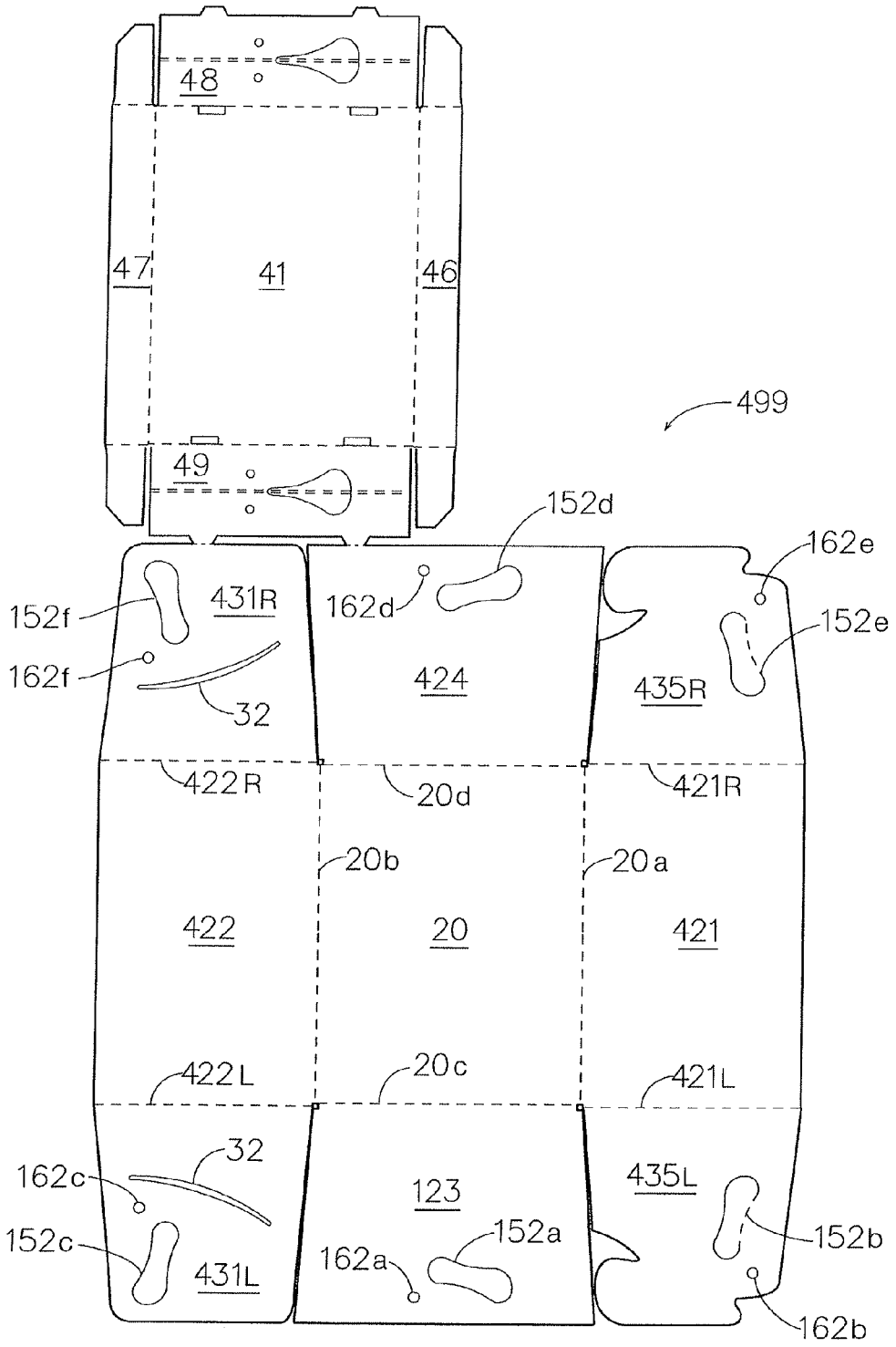
FIG. 16 shows a plan view of a blank for folding into the container box and lid of FIG. 15

FIG. 16 shows a blank 499 for forming the container box and lid of FIG. 15.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

I claim:

1. A container comprising a box, the box comprising:

a bottom panel having a front edge, a rear edge, a right edge and a left edge;

a front wall extending from the front edge of the bottom panel, and include a top portion having a grip opening;

a rear wall extending from the rear edge of the bottom panel, and include a top portion having a grip opening;

a right wall extending from the right edge of the bottom panel, the right wall having a front side edge and a rear side edge;

a left wall extending from the left edge of the bottom panel, the left wall having a front side edge and a rear side edge;

a front slotted wall member extending from one of the front side edge of the right wall or the front side edge of the left wall, the front slotted wall member having a grip opening, and a front tabbed wall member extending from the other of the front side edge of the right wall or the front side edge of the left wall, the front tabbed wall member having a grip opening;

a rear slotted wall member extending from one of the rear side edge of the right wall or the rear side edge of the left wall, the rear slotted wall member having a grip opening, and a rear tabbed wall member extending from the other of the rear side edge of the right wall or the rear side edge of the left wall, the rear tabbed wall member having a grip opening;

wherein the front tabbed wall member and the rear tabbed wall member include a neck and a tab that extends laterally from the neck, the tab including an upper lobe and a lower lobe;

wherein each of the front slotted wall member and the rear slotted wall member have a slot having an upper end and a lower end, wherein a first lateral distance from the upper end of the slot to the front side edge and to the rear side edge, respectively, from which the front slotted wall member and the rear slotted wall member extend, is less than a second lateral distance from the lower end of the slot to the front side edge and to the rear side edge, respectively, from which the front slotted wall member and the rear slotted wall member extend;

wherein the tab of the front tabbed wall member extends through the slot or the front slotted wall member to form a composite front wall comprising the front tabbed wall member secured to the front slotted wall member, and the tab of the rear tabbed wall member extends through the slot of the rear slotted wall member to form a composite rear wall comprising the rear tabbed wall member secured to the rear slotted wall member, and wherein the lower lobe extends a first vertical distance below the lower end of the slot, and the upper lobe extends a second vertical distance above the upper end of the slot; and wherein the grip opening of the front slotted wall member and the grip opening of the front tabbed wall member register with the grip opening of the front wall to form a front through-wall grip opening, and the grip opening of the rear slotted wall member and the grip opening of the rear tabbed wall member register with the grip opening of the rear wall to form a rear through-wall grip opening.

2. The container according to claim 1 further including a lid having a top surface that covers a top opening of the box.

3. The container according to claim 1 wherein the right wall and the left wall each include an upper portion having a grip opening.

4. The container according to claim 1 wherein the front wall is disposed on an inner surface of the composite front wall, and the rear wall is disposed on an inner surface of the composite rear wall.

5. The container according to claim 1 wherein the slot is a curved slot.

6. The container according to claim 1 wherein the slot is a straight slot.

7. The container according to claim 1 wherein the slot is oriented on the front slotted wall member and the rear slotted wall member between vertical and horizontal.

8. The container according to claim 1 wherein the first vertical distance of the lower lobe is greater than the second vertical distance of the upper lobe.

9. The container according to claim 1 wherein the first vertical distance of the lower lobe is less than the second vertical distance of the upper lobe.

* * * * *